US005795477A

United States Patent [19]

Herman et al.

[11] Patent Number: 5,795,477

[45] Date of Patent: Aug. 18, 1998

[54] SELF-DRIVEN, CONE-STACK TYPE CENTRIFUGE

[75] Inventors: Peter K. Herman; Byron A. Pardue, both of Cookeville, Tenn.

[73] Assignee: Fleetguard, Inc., Nashville, Tenn.

[21] Appl. No.: 847,861

[22] Filed: Apr. 28, 1997

Related U.S. Application Data

[63] Continuation of Ser. No. 583,634, Jan. 5, 1996, Pat. No. 5,637,217, which is a continuation of Ser. No. 378,197, Jan. 25, 1995, Pat. No. 5,575,912.

[51] Int. Cl.[6] ..... B04B 1/08

[52] U.S. Cl. ..... 210/360.1; 210/380.1; 494/70; 494/73

[58] Field of Search ..... 184/6.24; 210/360.1, 210/380.1, 168, DIG. 17; 494/49, 56, 76, 79, 68, 70, 71, 72, 73, 75, 80

[56] References Cited

U.S. PATENT DOCUMENTS

| | | | |
|---|---|---|---|
| 882,119 | 3/1908 | Ohlsson . | |
| 993,791 | 5/1911 | Ohlsson . | |
| 1,006,622 | 10/1911 | Bailey | 494/75 |
| 1,038,607 | 9/1912 | Lawson . | |
| 1,136,654 | 4/1915 | Callane . | |
| 1,151,686 | 8/1915 | Hult et al. . | |
| 1,232,811 | 1/1917 | Kimball . | |
| 1,482,418 | 2/1924 | Unger . | |
| 1,784,510 | 12/1930 | Berline . | |
| 2,031,734 | 2/1936 | Riebel, Jr. et al. . | |
| 2,302,381 | 11/1942 | Scott . | |
| 2,305,469 | 12/1942 | Forsberg . | |
| 2,665,060 | 1/1954 | Harstick . | |
| 2,725,190 | 11/1955 | Hein et al. . | |
| 2,735,614 | 2/1956 | Hubmann . | |
| 2,738,923 | 3/1956 | Harstick . | |
| 2,752,090 | 6/1956 | Kyselka et al. . | |
| 2,755,017 | 7/1956 | Kyselka et al. . | |
| 3,187,998 | 6/1965 | Madany . | |
| 3,858,793 | 1/1975 | Dudrey . | |
| 3,990,631 | 11/1976 | Schall . | |
| 4,067,494 | 1/1978 | Willus et al. . | |
| 4,106,689 | 8/1978 | Kozulla . | |
| 4,288,030 | 9/1981 | Beazley et al. . | |
| 4,325,825 | 4/1982 | Schutte . | |
| 4,400,167 | 8/1983 | Beazley et al. . | |
| 4,427,407 | 1/1984 | Paschedag . | |
| 4,460,352 | 7/1984 | Bruning . | |
| 4,787,975 | 11/1988 | Purvey . | |
| 4,915,682 | 4/1990 | Stroucken . | |
| 4,961,724 | 10/1990 | Pace . | |
| 5,045,049 | 9/1991 | Lantz . | |
| 5,052,996 | 10/1991 | Lantz . | |

FOREIGN PATENT DOCUMENTS

| | | |
|---|---|---|
| 444256 | 1/1949 | Italy . |

*Primary Examiner*—David A. Reifsnyder
*Attorney, Agent, or Firm*—Woodard, Emhardt, Naughton, Moriarity & McNett

[57] ABSTRACT

A bypass circuit centrifuge for separating particulate matter out of a circulating liquid includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly and a pair of oppositely disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The incoming liquid flow exits the centertube through a pair of oil inlets and from there is directed into the stacked array of cones. In one embodiment, a top plate in conjunction with ribs on the inside surface of the centrifuge bowl accelerate and direct this flow into the upper portion of the stacked array. In another embodiment the stacked array is arranged as part of a disposable subassembly. In each embodiment, as the flow passes through the channels created between adjacent cones, particle separation occurs as the liquid continues to flow downwardly to the tangential flow nozzles.

15 Claims, 18 Drawing Sheets

SELF-DRIVEN, CONE-STACK TYPE CENTRIFUGE

This application is a continuation of application Ser. No. 08/583,634, filed Jan. 5, 1996, now U.S. Pat. No. 5,632,217 which is a CIP of Ser. No. 08/378,197 filed Jan. 25, 1995, now U.S. Pat. No. 5,575,912.

BACKGROUND OF THE INVENTION

The present invention relates generally to the continuous separation of solid particles from a liquid by the use of a centrifugal field. More particularly the present invention relates to the use of a cone (disc) stack centrifuge configuration within a self-driven centrifuge in order to achieve enhanced separation efficiency.

Diesel engines are designed with relatively sophisticated air and fuel filters (cleaners) in an effort to keep dirt and debris out of the engine. Even with these air and fuel cleaners, dirt and debris will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over smaller particles, designers have gone to bypass filtering systems which filter a predetermined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers a substantial improvement over the use of only a full flow filter.

The desire to remove these smaller particles of dirt has resulted in the design of high speed centrifuge cleaners. One product which is representative of this design evolution is the SPINNER II® oil cleaning centrifuge made by Glacier Metal Company Ltd., of Somerset, Ilminister, United Kingdom, and offered by T. F. Hudgins, Incorporated, of Houston, Tex. The following description of the SPINNER II® product is taken directly from a product brochure copyrighted in 1985 and published by T. F. Hudgins, Incorporated:

> Now there is SPINNER II®. It is a true high-speed centrifuge that removes dense, hard, abrasive particles as tiny as 0.1 micron. That's 400 times smaller than the dirt removed by your full-flow filter. And because the SPINNER II® is a real centrifuge that slings dirt out of the path of circulating oil, it maintains a constant flow throughout its operating cycle. In fact, tests show that the SPINNER II® unit is so good, it reduces engine wear half-again as much as even the best full-flow/bypass filter combination.
>
> Best of all, the SPINNER II® oil cleaning centrifuge is low-cost because it is powered only by the engine's own oil pressure: less than five percent of the cost of the traditional electric-motor-driven centrifuge. Now you can install the most cost-effective oil cleaning system with the best wear reduction available today—on all your industrial engines.

The construction and operating theory of the SPINNER II® oil cleaning centrifuge is described in the foregoing publication in the following manner:

> The SPINNER II® oil cleaning centrifuge consists of three sections—the centrifuge bowl, the driving turbine and the oil-level control mechanism—all contained in a rugged steel and cast aluminum housing.
>
> To get to the centrifuge, dirty oil from the engine enters the side of the SPINNER II® housing and travels up through the hollow spindle. At the top of the spindle, a baffle distributes the oil uniformly into the centrifuge bowl. Because the bowl spins at about 7500 rpm, the oil quickly accelerates to a high speed. The resulting centrifugal force slings dirt outwardly onto the bowl wall where it mats into a dense cake.
>
> Clean oil leaves the bowl through the screen and enters the turbine section. Here the engine's oil pressure expels the oil through two jets that spin the turbine and attached centrifuge bowl. Oil pressure alone drives this highly efficient unit.

While the SPINNER II® might seem to be the complete answer to the task of effective oil filtration and cleaning, there are other high-speed centrifuge designs. There are also design shortcomings with the SPINNER II® from the standpoint of filtering or cleaning efficiency. First, with regard to other high-speed centrifuge designs, the SPINNER II® literature makes reference to other high-speed, electric-motor-driven centrifuges, such as those made by Alfa Laval, Bird, and Westphalia. As stated by the SPINNER II® literature, these motor-driven centrifuges are "too expensive (upwards of $10,000) and too complex for general use".

With regard to the aforementioned design inefficiencies of the SPINNER II®, FIG. 1 represents a diagrammatic, cross-sectional view of the type of self-driven centrifuge which is similar to or representative of the SPINNER II® design. All components shown in the FIG. 1 drawing rotate upon a shaft which provides pressurized oil to the inlet ports of the centertube. After passing through the two inlet ports of the rotating spindle or tube, the oil is directed towards the top of the shell (bowl) by the top baffle. The oil then spills over the baffle and short circuits directly toward the outlet screen, leaving a majority of the centrifuge body in a completely stagnant condition. This result is unfortunate because the centrifugal force increases proportionately with distance from the axis and in this design, the flow stays very close to the axis. After passing the outlet screen, the oil passes underneath the bottom baffle plate and exits through two tangential directed nozzles which also serve to limit the oil flow rate through the centrifuge. The high velocity jets exiting the two nozzles generate the reaction torque needed to drive the centrifuge at sufficiently high rotation speeds for particle separation (3000–6000 rpm).

As stated in the SPINNER II® product literature, there are other high speed centrifuges, including electric-motor-driven designs such as those made by Alfa Laval. Besides being motor-driven, the Alfa Laval design is appropriate to consider relative to the present invention for its use of a disc-stack assembly. The disc inserts which comprise the heart of the disc-stack assembly enable the sedimentation height to be reduced, thereby resulting in greater filtering efficiency. The disc inserts are conical in shape and are assembled with circular or long rectangular plates known as caulks which are fitted between adjacent disc inserts. Separation channels are formed as a result and the thickness of the caulks may be varied so as to adjust the height of the separation channel for the particular particle size and concentration. The theory of operation and structure of the Alfa Laval disc stack separators are described in the Alfa Laval product literature and are believed to be well known to those of ordinary skill in the art. One such Alfa Laval publication is entitled "Theory of Separation" and was published by Alfa Laval Separation AB of Tumba, Sweden. Another publication with a similar disclosure or teaching was an article entitled "New Directions in Centrifuging" which was published in the January, 1994 issue of *Chemical Engineering*, pages 70–76, authored by Theodore De Loggio and Alan Letki of Alfa Laval Separation Inc.

The flow of liquid through some of the Alfa Laval disc-stack separator arrangements begins with the liquid entering at the top and flowing to the bottom where it is radially diverted and flows upwardly toward the fluid exit locations. The upward flowing liquid enters each separation channel at its outer radius edge and flows upwardly and radially inward through the channel to its point of exit at the inner radius edge. Separation of solid particles takes place as the liquid flows through the separation channels. In other Alfa Laval arrangements the flow through the disc-stack begins at an upper edge. However, in both styles the fluid exit location is at the top of the assembly.

After considering the design features and performance aspects of the centrifuge arrangements which are generally depicted by the aforementioned SPINNER II® and Alfa Laval structures, the inventors of the present invention conceived of an improved design for a bypass circuit centrifuge. Involved in the design effort by the present inventors was the use of computational fluid dynamics analysis of self-driven engine lube system centrifuges and this analysis revealed sub-optimal flow conditions from a particle separation standpoint. Additional research revealed that a greater degree of separation efficiency in a centrifuge could be achieved by using a stack of cones so as to reduce the necessary particle settling distance. However, the Alfa Laval centrifuge requires a motor-drive arrangement which represents a significant drawback from the standpoint of size, weight and cost.

What the present invention achieves is a combination of the low cost self-driven type centrifuge similar in some respects to the SPINNER II but with the efficiency enhancement provided by a unique arrangement of stacked cones. The result is a cost effective, higher performance centrifuge which can be used to replace engine mounted disposable bypass filters. Although it was initially theorized that the self-driven centrifuge concept would not provide sufficient power to drive the stacked cone type of centrifuge, specific provisions have been made by the present invention to enable that combination in a unique and unobvious way. As conceived, the improved design of the present invention captures the lower cost benefits of the self-driven centrifuge with the greater efficiency of the disc-stack of cones. Due to the specific flow directions of the oil through the SPINNER II® and through the disc-stack configuration of the described Alfa Laval concept, a direct combination of these two designs was not possible. Specific and unique components had to be created in order to make the flow directions compatible and in order to enable a disc-stack of cones to be integrated into a self-driven bypass circuit centrifuge.

According to one embodiment of the present invention, a bypass circuit centrifuge is provided for maintaining cleanliness of an engine lubricant sump. The centrifuge is self-driven with system oil pressure by means of tangential nozzles and further contains a stack of closely spaced parallel truncated cones in order to increase separation efficiency. In another embodiment of the present invention a replaceable, disposable cone-stack subassembly is provided for quick assembly into and disassembly from the centrifuge.

After evaluating the benefits to be derived from combining a cone stack separator into a self-driven centrifuge, the present inventors conceived of a novel and unobvious design enhancement. Since a direct combination by means of a simple substitution was not possible, various plates and mounting arrangements had to be created so as to create and define the desired flow path. The FIG. 2 illustration is representative of the first design embodiment according to the present invention. The incoming oil is routed through the assembly so that the flow enters the narrow space between adjacent cones at a radially outer flow entrance and travels in a radially inclined, inward direction toward the axis of rotation. Radially inner apertures in each cone permit the oil to flow from the cone stack to a pair of tangential flow nozzles. The exiting nozzle pressure imparts a spinning motion (self-driven) to the cone stack, causing the heavier particles which are suspended in the oil to be forced in a radially outward direction, against the direction of radially inclined flow. As these particles exit from between the cones, they are accumulated as sludge on the inside surface of the centrifuge bowl. The thickness of the sludge layer increases over time, and eventually, the sludge begins to build up within the outside diameter of the cone stack. The "sludge" referred to herein is a very dense asphalt-like material which is very difficult to clean.

At some point the sludge build up may become substantial and could interfere with the continued, acceptable operation of the cone stack centrifuge. It then becomes necessary to disassembly the centrifuge and clean the component parts. While this procedure can be routinely handled, there are a number of parts which need to be disassembled and cleaned. Care must be taken while handling the parts to prevent possible damage. Care must also be exerted to ensure that the cones are properly stacked and aligned during reassembly. While this procedure may take time, it does enable some parts to be reused, over and over again. Since some users may wish to reduce the cleaning time, the present inventors considered other design variations to what is illustrated in FIG. 2. The inventors reasoned that one option to reduce the cleaning time would be to provide a disposable cone-stack subassembly. Consequently, the present inventors additionally directed their efforts to designing a cone stack, self-driven centrifuge with a replaceable, disposable cone stack subassembly. The result of this design effort is represented by another embodiment of the present invention which is illustrated and described herein.

This "replaceable" subassembly embodiment of the present invention includes three basic components, a plastic liner shell, a cone-stack of thirty-four (34) individual plastic cones, and a plastic bottom plate. These components are each molded of a non-filled (incinerable) plastic which is capable of withstanding the heat and chemical environment now found in an engine lube system. Nylon 6/6 is a likely candidate, although other materials would be suitable. This cone stack subassembly is designed to mate with a permanent centrifuge bowl which is reused.

The "replaceable" subassembly embodiment provides a cone stack centrifuge design which can be quickly and easily serviced. There is no requirement to clean out sludge from the centrifuge bowl nor is there any need to clean the cones and go through the time consuming task of disassembly and reassembly of the cones. The sludge load is contained entirely within the liner shell, contributing to the overall cleanliness and ease of handling. The cone stack subassembly is fabricated out of all plastic parts, thereby permitting incineration or recycling. The cone stack subassembly of the present invention is effectively preassembled which eliminates potential failure modes caused by improper assembly in the field.

The embodiments of the present invention have a broader range of application than merely engine lubricants. The disclosed centrifuge designs can be used for a variety of fluids whenever it is desired to separate particulate matter out of a circulating flow, assuming that the necessary fluid pressure is present to drive the centrifuge.

In addition to the product literature already mentioned, there are a number of patents which disclose various filtering and centrifuge designs and advance a variety of theories as to the specific and preferred operation. The following patent references are believed to provide a representative sampling of such earlier designs and theories.

U.S. Patents:

| U.S. Pat. No. | PATENTEE | ISSUE DATE |
|---|---|---|
| 955,890 | Marshall | Apr. 26, 1910 |
| 1,006,662 | Bailey | Oct. 24, 1911 |
| 1,038,607 | Lawson | Sep. 17, 1912 |
| 1,136,654 | Callane | Apr. 20, 1915 |
| 1,151,686 | Hult et al. | Aug. 31, 1915 |
| 1,293,114 | Kendrick | Feb. 4, 1919 |
| 1,422,852 | Hall | Jul. 18, 1922 |
| 1,482,418 | Unger | Feb. 5, 1924 |
| 1,525,016 | Weir | Feb. 3, 1925 |
| 1,784,510 | Berline | Dec. 9, 1930 |
| 2,031,734 | Riebel, Jr. et al. | Feb. 25, 1936 |
| 2,087,778 | Nelin | Jul. 20, 1937 |
| 2,129,751 | Wells et al. | Sep. 13, 1938 |
| 2,302,381 | Scott | Nov. 17, 1942 |
| 2,321,144 | Jones | Jun. 8, 1943 |
| 2,578,485 | Nyrop | Dec. 11, 1951 |
| 2,752,090 | Kyselka et al. | Jun. 26, 1956 |
| 2,755,017 | Kyselka et al. | Jul. 17, 1956 |
| 3,036,759 | Bergner | May 29, 1962 |
| 3,990,631 | Schall | Nov. 9, 1976 |
| 4,067,494 | Willus et al. | Jan. 10, 1978 |
| 4,106,689 | Kozulla | Aug. 15, 1978 |
| 4,221,323 | Courtot | Sep. 9, 1980 |
| 4,230,581 | Beazley | Oct. 28, 1980 |
| 4,262,841 | Berber et al. | Apr. 21, 1981 |
| 4,288,030 | Beazley et al. | Sep. 8, 1981 |
| 4,346,009 | Alexander et al. | Aug. 24, 1982 |
| 4,400,167 | Beazley et al. | Aug. 23, 1983 |
| 4,498,898 | Haggett | Feb. 12, 1985 |
| 4,615,315 | Graham | Oct. 7, 1986 |
| 4,698,053 | Stroucken | Oct. 6, 1987 |
| 4,787,975 | Purvey | Nov. 29, 1988 |
| 4,861,329 | Borgström | Aug. 29, 1989 |
| 4,915,682 | Stroucken | Apr. 10, 1990 |
| 4,961,724 | Pace | Oct. 9, 1990 |
| 5,052,996 | Lantz | Oct. 1, 1991 |
| 5,342,279 | Cooperstein | Aug. 30, 1994 |
| 5,354,255 | Shapiro | Oct. 11, 1994 |
| 5,362,292 | Börgstrom et al. | Nov. 8, 1994 |
| 5,374,234 | Madsen | Dec. 20, 1994 |
| 1,006,622 | Bailey | Oct. 24, 1911 |
| 1,136,654 | Callane | Apr. 20. 1915 |
| 1,151,686 | Hult et al. | Aug. 31, 1915 |
| 1,784,510 | Berline | Dec. 9, 1930 |
| 2,031,734 | Riebel, Jr. et al. | Feb. 25, 1936 |
| 2,302,381 | Scott | Nov. 17, 1942 |
| 2,752,090 | Kyselka et al. | Jun. 26, 1956 |
| 2,755,017 | Kyselka et al. | Jul. 17, 1956 |
| 3,990,631 | Schall | Nov. 9, 1976 |
| 4,067,494 | Willus et al. | Jan. 10, 1978 |
| 4,915,682 | Stroucken | Apr. 10, 1990 |
| 4,961,724 | Pace | Oct. 9, 1990 |
| 5,052,996 | Lantz | Oct. 1, 1991 |

-continued

Foreign Patents:

| PATENT NO. | COUNTRY | ISSUE DATE |
|---|---|---|
| 1,507,742 | British | Apr. 19, 1978 |
| 2,049,494A | Great Britain | Dec. 31, 1980 |
| 1,275,728 | France | Oct. 2, 1961 |
| 1,089,355 | Great Britain | Nov. 1, 1967 |
| 812,047 | Great Britain | Apr. 15, 1959 |
| 229,647 | Great Britain | Feb. 26, 1926 |
| 1,079,699 | Canada | Jun. 17, 1980 |

SUMMARY OF THE INVENTION

A bypass circuit centrifuge which is assembled onto a center support shaft and within an outer cover assembly for separating particulate matter out of a circulating liquid according to one embodiment of the present invention comprises a centrifuge bowl, a base plate assembled to the centrifuge bowl, the base plate including at least one tangential flow nozzle, a hollow centertube positioned on the support shaft and axially extending through the base plate and through the interior of the centrifuge bowl, a flow-control member positioned adjacent an upper end of the centertube, a bottom plate spaced apart from the flow-control member and positioned closer to the base plate, and a plurality of truncated cones positioned into a stacked array which is positioned between the flow-control member and the bottom plate, the plurality of truncated cones being constructed and arranged so as to define a plurality of liquid flow paths from an outer opening to a radially inner opening, the flow paths being in flow communication with the flow nozzle.

A self-driven, cone stack centrifuge according to another embodiment of the present invention comprises a reusable centrifuge bowl and a disposable cone-stack subassembly positioned within the centrifuge bowl. The cone-stack subassembly includes an annular liner shell having a flow control first end and opposite thereto an open second end, an annular bottom plate attached to the open second end of the liner shell and defining with the liner shell an interior cone space and a plurality of separation cones arranged into a stacked array and positioned within the interior cone space.

One object of the present invention is to provide an improved bypass circuit centrifuge.

Related objects and advantages of the present invention will be apparent from the following description.

DESCRIPTION OF THE PREFERRED EMBODIMENT

Figure 1:
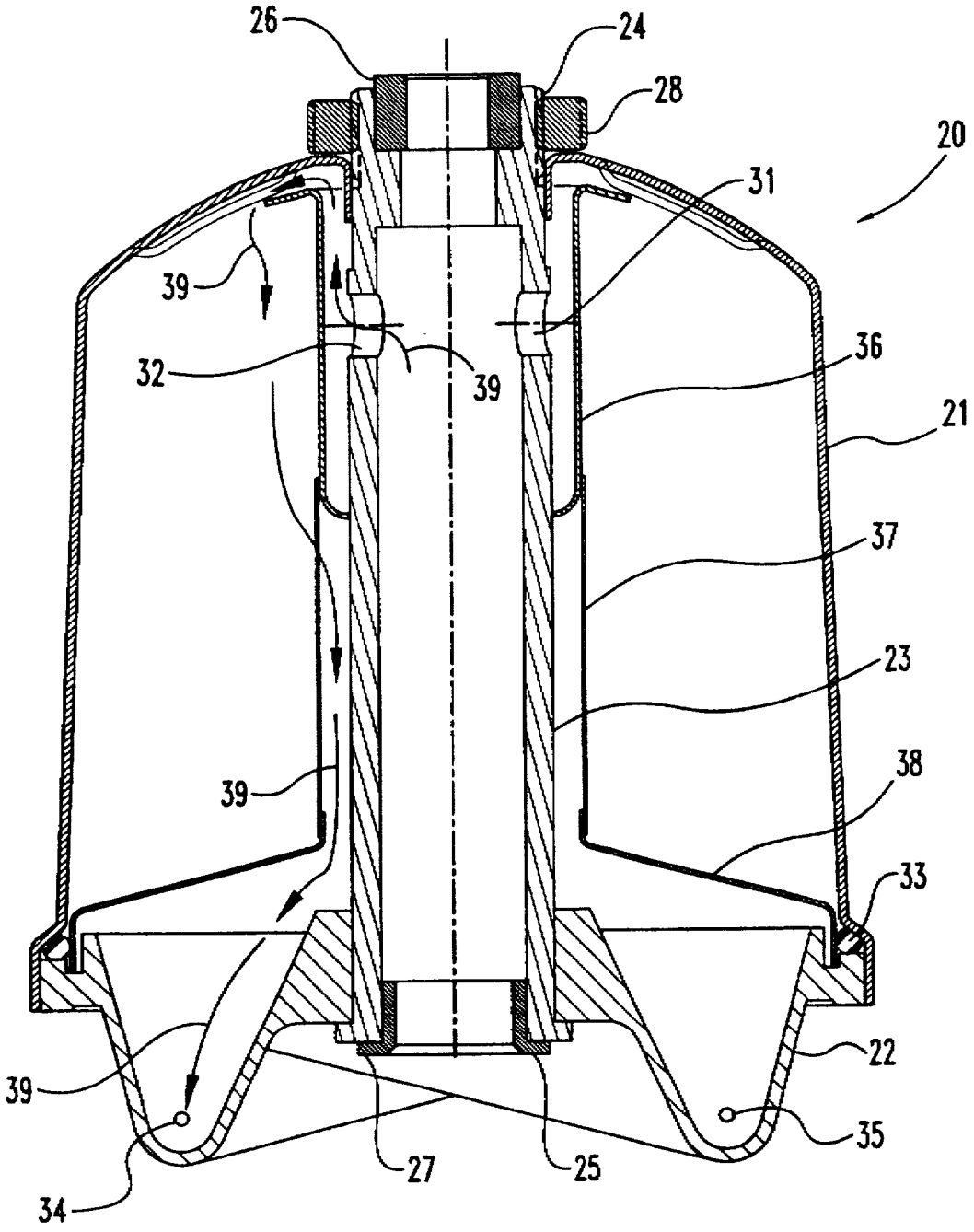
FIG. 1 (PRIOR ART)
FIG. 1 is a front elevational view in full section of a self-driven centrifuge which generally corresponds to a prior art construction.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a self-driven centrifuge 20 which is representative of the prior art construction. Centrifuge 20 includes an outer housing or centrifuge bowl 21 which is securely sealed to and around base plate 22. Bowl 21 has an open lower end and a smaller clearance opening at its upper end. Axially extending through the geometric center of plate 22 and through the interior of centrifuge bowl 21 is hollow bearing tube 23. Tube 23 is externally threaded adjacent upper end 24 and is shouldered at its lower opposite end 25. Tube 23 is fitted at each end with brass bearings 26 and 27. Nut 28 securely assembles the tube 23 to bowl 21 and plate 22. Tube 23 includes oil inlet ports 31 and 32 and annular seal 33 is positioned against the inside annular corner defined by bowl 21 and plate 22. At the lower region of plate 22 there are two tangential nozzle orifices 34 and 35. These tangential nozzles orifices are symmetrically positioned on opposite sides of the axis of the centertube 23 and their corresponding flow jet directions are opposite to one another. As a result, these flow nozzles are able to create the driving force for spinning centrifuge 20 about a center shaft within a cooperating cover assembly (not shown), as is believed to be well known in the art. It is possible to create a spinning motion with a single flow nozzle or use more than two flow nozzles. In the FIG. 1 illustration the cutting plane has been modified from a full 180 degree plane in order to show both flow nozzles.

The centrifuge 20 further includes an upper baffle 36, outlet screen 37, and bottom baffle 38. The baffles and screen are cooperatively assembled so as to help define the flow path for the liquid flowing through centrifuge 20. All components shown in FIG. 1 rotate upon a shaft (not shown) that provides pressurized oil to the oil inlet ports 31 and 32. After passing through the rotating tube inlet ports 31 and 32, the oil is directed towards the top of the bowl 21 by upper baffle 36. The oil then spills over the baffle in an outward, radial direction and short circuits directly towards the outlet screen 37 as illustrated by the flow arrows 39 provided on one side of the FIG. 1 illustration. The result of this particular flow path is that a majority of the interior of the centrifuge bowl is left in a completely stagnant condition. This fact has been revealed by computational fluid dynamics analysis. This particular drawback is a disadvantage to this self-driven design because the centrifugal force increases proportionately with the distance from the axis of rotation. In the disclosed FIG. 1 design, the liquid flow stays very close to the axis, resulting in the annular stagnant zone outwardly of the illustrated flow path.

After passing through the outlet screen 37, the oil passes beneath the bottom baffle 38 and exits through the two tangential directed nozzles (nozzle orifices) 34 and 35. These nozzle orifices also serve to limit the oil flow rate through the centrifuge. The high velocity jet exiting from each nozzle orifice generates a reaction torque which is needed to drive the centrifuge at sufficiently high rotation speeds for particle separation (3000–6000 rpm). This rotation occurs within a cooperating cover assembly (not shown).

Figure 2:
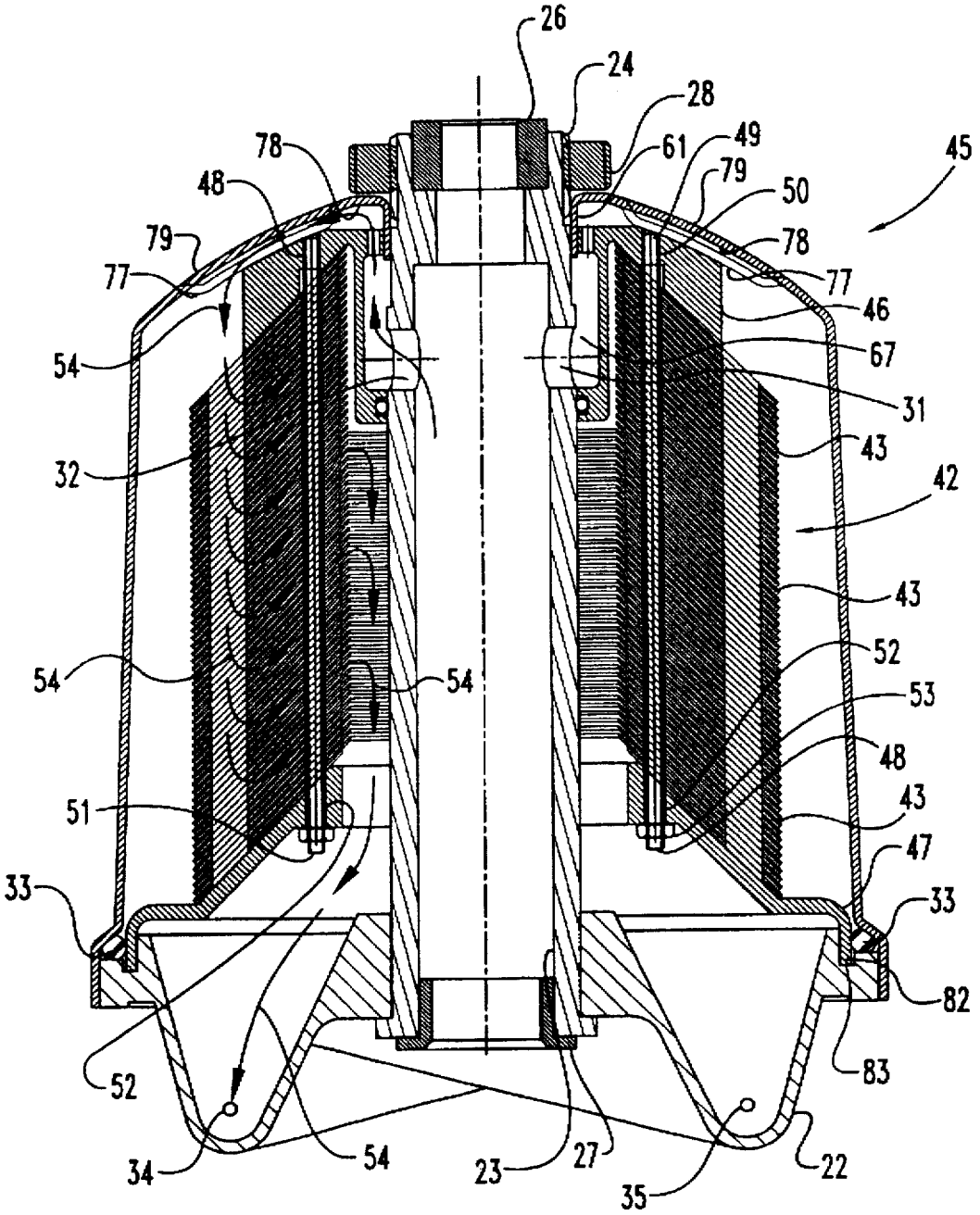
FIG. 2 is a diagrammatic front elevational view in full section of a bypass circuit centrifuge according to a typical embodiment of the present invention.

Referring to FIG. 2, a preferred embodiment of the present invention is illustrated and begins with several of the primary structural components of self-driven centrifuge 20. Initially it should be noted that in the FIG. 2 illustration of the present invention, the upper baffle 36, outlet screen 37, and bottom baffle 38 have been removed. To some extent these components have been replaced by different components and another significant change is that the interior of bowl 21 now receives a series or stack 42 of truncated cones 43 (see FIGS. 7 and 8) which are assembled together in a uniform and substantially parallel stack. In the preferred embodiment as illustrated, there are sixty-three (63) cones.

The stack 42 of cones 43 is provided in order to create an improved centrifuge design with enhanced efficiency according to the present invention.

It is to be understood that the number of cones can increase or decrease depending on the available space for the stack, the cone wall thickness and the separation distance between adjacent cones. A significant improvement in cleaning efficiency can be achieved with only five or six cones in a stack.

Self-driven, cone-stack centrifuge 45 includes outer housing or centrifuge bowl 21 which is securely sealed to and around base plate 22. The configuration of tube 23 and its mounting provisions as illustrated in FIG. 2 are substantially the same as illustrated in FIG. 1. In addition to the series 42 of stacked truncated cones 43, the FIG. 1 centrifuge 20 is modified by the addition of machined top plate 46 and machined bottom plate 47. Further, three equally spaced threaded rods 48 (two of which are illustrated) extend through the stack 42 of sixty-three truncated cones 43. These three threaded rods serve to help center and align the stack of truncated cones. The upper end 49 of each threaded rod 48 is received within a corresponding threaded hole 50 in machined top plate 46 (see FIGS. 3 and 4). The lower end 51 of each threaded rod 48 extends through a corresponding one of three equally spaced clearance holes 52 which are positioned in machined bottom plate 47 (see FIGS. 5 and 6). The lower end 51 of each threaded rod 48 may be secured by means of hex nuts 53 (as illustrated) or left free in the axial direction.

Figure 8:
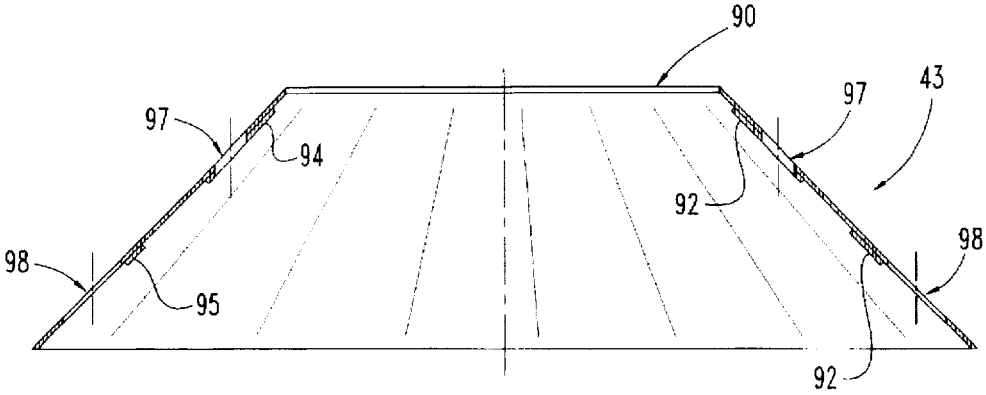
FIG. 8 (PRIOR ART)
FIG. 8 is an enlarged front elevational view in full section of the FIG. 7 truncated cone as viewed in the direction of arrows 8—8 in FIG. 7 and inverted to agree with the FIG. 2 orientation.
Figure 7:
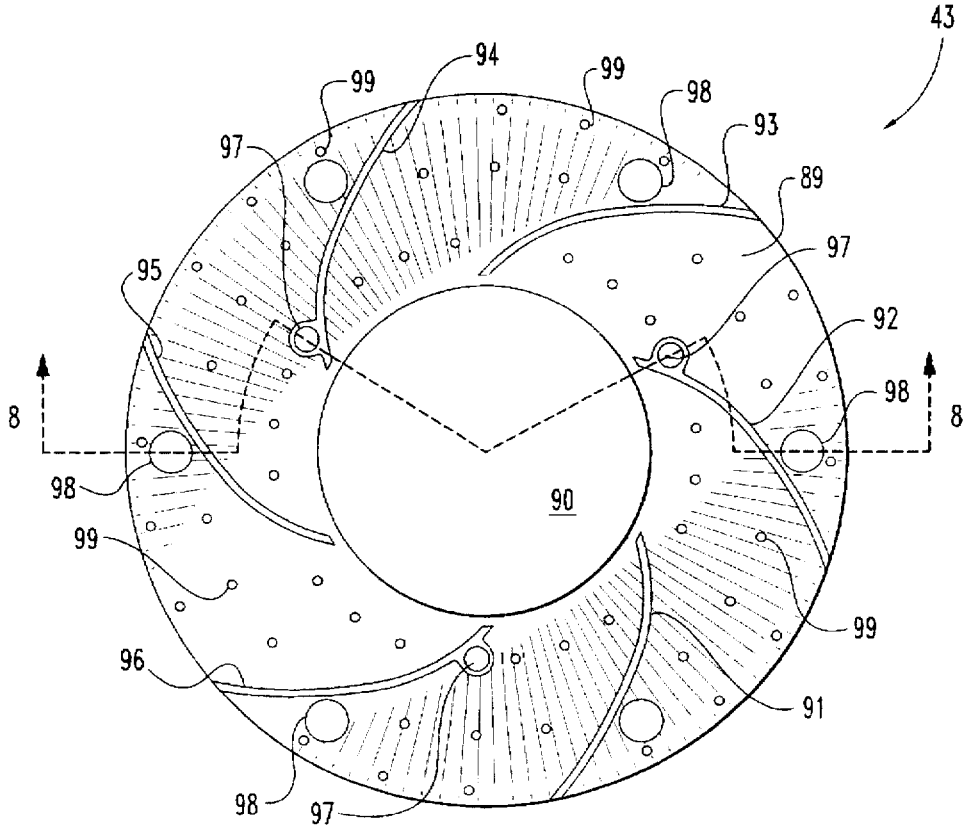
FIG. 7 (PRIOR ART)
FIG. 7 is a bottom plan view of a truncated cone which may be used as one portion of the FIG. 2 centrifuge according to the present invention, the illustrated cone generally corresponding to a prior art construction.

Each of the sixty-three cones 43 are substantially identical in construction, the details of which are illustrated in FIGS. 7 and 8. While these cones are similar to other stacked cones as to certain aspects of centrifuge separation theory, the flow direction has been changed from earlier designs. In the present invention, as depicted in FIG. 2, (note the direction of the flow arrows 54), the initial flow of liquid as it reaches stack 42 begins at the top or uppermost edge of stack 42. The flow path of the present invention is in contrast to certain styles of Alfa Laval stacked cones (reference the Background portion) wherein the initial flow begins at the bottom of the stack and moves upward through the stacked cones to a liquid exit location. Even with those Alfa Laval configurations where the flow through the stacked cones begins at the top, both the flow inlet and exits are at the top of the unit. The modified flow path of the present invention was specifically designed and configured utilizing the configuration of top plate 46 in order to utilize the liquid flow as part of a self-driven centrifuge design. The additions of top plate 46 and bottom plate 47 are important in order to be able to position the sixty-three truncated cones 43 in the desired and necessary orientation. Top plate 46 further contributes to the creation of the desired liquid flow direction and creation of the desired velocity for the flow. Similarly, bottom plate 47 contributes to the flow direction of the liquid which is being separated so that the exiting flow from the stack 42 can be properly directed to the tangential flow nozzle orifices 34 and 35.

In the operation of centrifuge 45 the oil which enters through the centertube 23 is directed through oil inlet ports 31 and 32. As the oil leaves the inlet ports, it is not permitted to freely cascade over an upper baffle as in the FIG. 1 design. Instead, the oil is first directed through a plurality of annularly spaced openings in the top plate 46 and then through passages defined by depending radial ribs formed on the inside surface of the top wall of the bowl in cooperation with the top surface of the top plate. The cooperating fit between these two components serves to prevent the fluid from tangential slipping since the fluid is greatly accelerated in the tangential direction as it proceeds outwardly. Once the fluid is passed the top plate and the acceleration vanes which have been created, it turns toward the base plate and spreads out evenly between the multiple parallel gaps between adjacent cones 43. The flow then proceeds back towards the center of bowl 21. As the oil flows inward and upward, between adjacent cones 43, it is prevented from "spinning up" (i.e., acceleration in the direction of rotation) by radial vanes positioned between the cone passages which prevent tangential fluid slip. In this way the energy that was expended to accelerate the fluid on the way out is recovered on the way back. Once the fluid has passed through the cone passages, it turns toward the base plate 22 and flows under bottom plate 47 and through the flow nozzle orifices 34 and 35.

Figure 3:
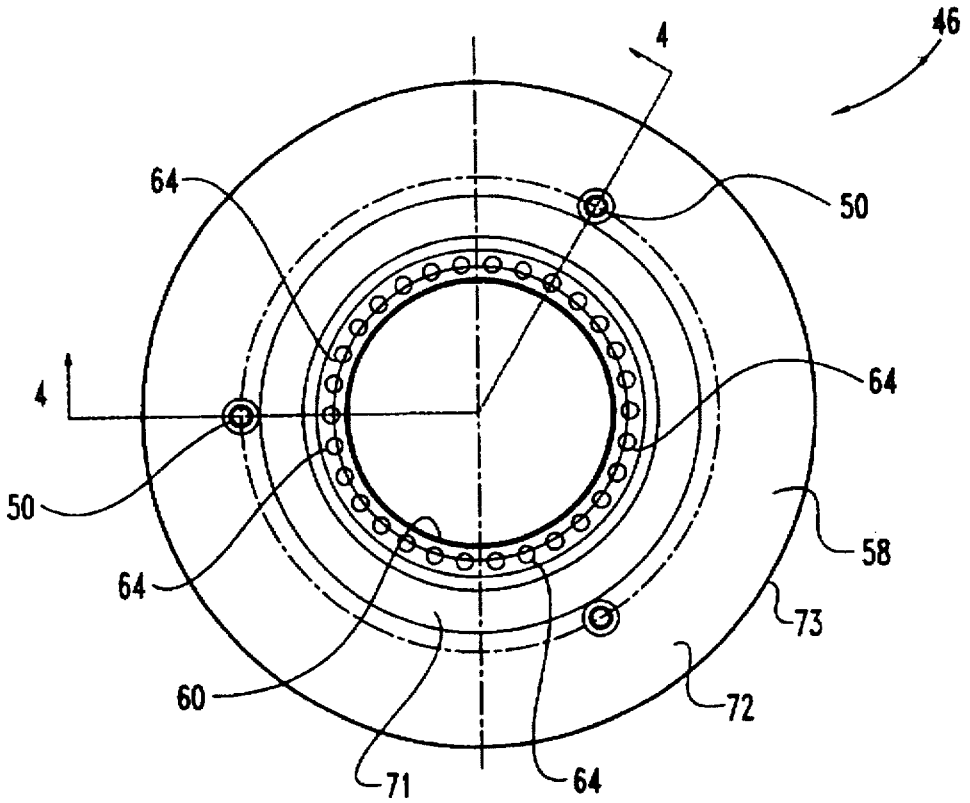
FIG. 3 is a top plan view of a top plate which comprises one component of the FIG. 2 centrifuge.
Figure 4:
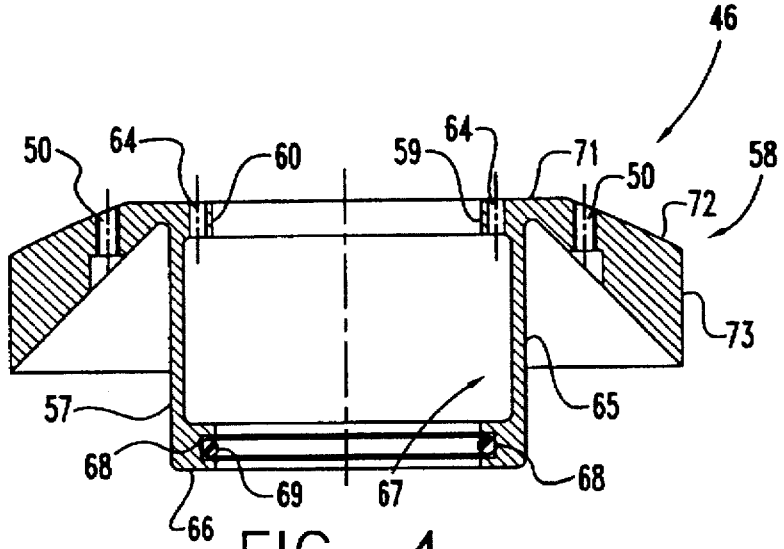
FIG. 4 is a front elevational view in full section of the FIG. 3 top plate as viewed in the direction of arrows 4—4 in FIG. 3.

Referring to FIGS. 3 and 4, the machined top plate 46 is illustrated in greater detail, including a top plan view in FIG. 3 and a front elevational view in full section in FIG. 4. Top plate 46 is a hollow annular member with a generally cylindrical lower body 57 and an annular upper flange 58 which generally increases in axial thickness as it extends radially outwardly. Inner lip 59 includes a generally cylindrical inner wall 60 which is arranged to abut up against an inner wall portion 61 of bowl 21 (see FIG. 2). Inner wall portion 61 is positioned between wall 60 and the upper end 24 of tube 23.

Inner lip 50 includes an equally spaced series of thirty (30) flow-through clearance holes 64 which provide a flow path for the liquid (oil) which exits from the oil inlet ports 31 and 32. The undercut nature of wall 65 of lower body 57 relative to lip 59 and lower flange 66 provides a clearance region 67 adjacent inlet ports 31 and 32 for directing the oil flow through clearance holes 64.

Annular lower flange 66 is arranged with an annular inner O-ring channel 68 which is fitted with an elastomeric O-ring 69. Flange 66 abuts up against the outside diameter of tube 23 immediately below the oil inlet ports 31 and 32 and in conjunction with O-ring 69 creates a liquid-tight seal at that location.

Annular upper flange 58 includes a generally horizontal top surface 71 which extends into the top surface of inner lip 59 and a spherical surface 72 which extends between surface 71 and outer wall portion 73. Three internally threaded, axially extending holes 50 are positioned in flange 58 and extend through surface 72. The three holes are equally spaced on 120 degree centers. The internal thread pitch is the same as the external thread pitch on the upper ends 49 of rods 48.

A spaced series of inwardly or downwardly directed and radially extending ribs 77 are formed on the inside surface 78 of the curved or domed portion 79 of bowl 21 (see FIG. 2). As illustrated in FIG. 2, spherical surface 72 abuts up against these ribs 77 in order to create flow channels or vanes which are used to accelerate the liquid flow which exits from the thirty clearance holes 64.

Figure 3A:
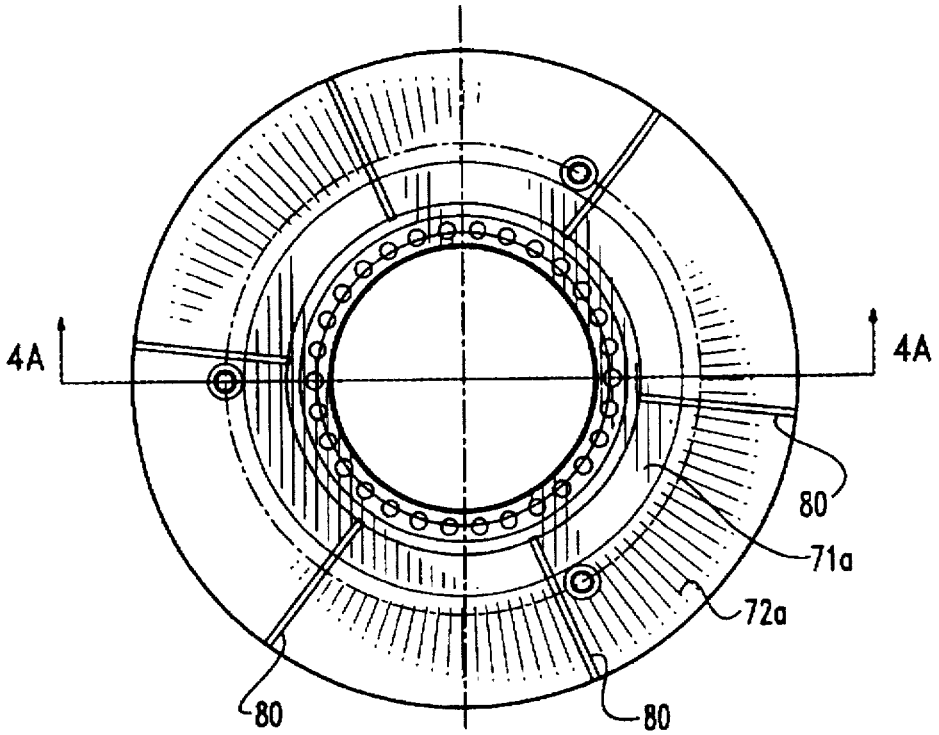
FIG. 3A is a top plan view of an alternative top plate according to the present invention.
Figure 4A:
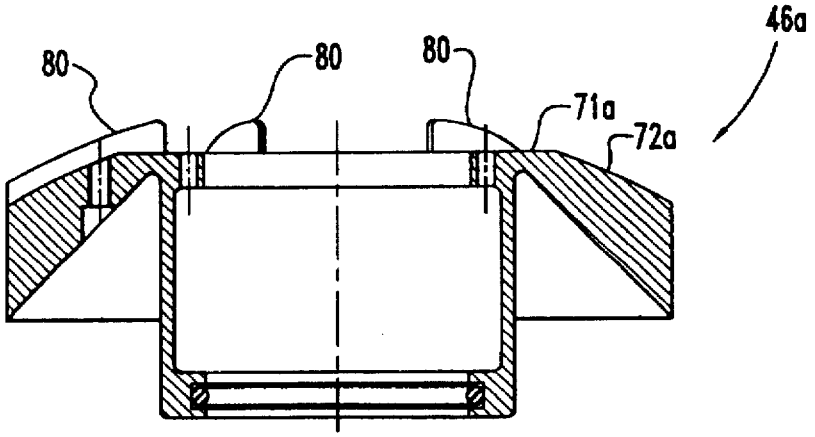
FIG. 4A is a front elevational view in full section of the FIG. 3A top plate as viewed in the direction of arrows 4A—4A in FIG. 3A.

Referring now to FIGS. 3A and 4A an alternative machined top plate **46*a* is illustrated. Top plate 46*a* is identical in all respects to top plate 46 with one exception. The spherical surface 72*a* of top plate 46*a* and a portion of surface 71*a* includes a series of outwardly radiating (straight) ribs 80. In the preferred embodiment there are a total of six ribs 80 which are equally spaced across surface 72*a*. Ribs 80 which are integrally formed as part of top plate 46*a* are designed to replace ribs 77 which are positioned on the inside surface 78 of portion 79 of bowl 21. Once ribs 77** are removed the inside surface 78 will have a smoothly curved or domed shape (spherical) and its curvature will be matched by the top surfaces of ribs 80 so that the desired flow channels (vanes) will be created.

Figure 6:
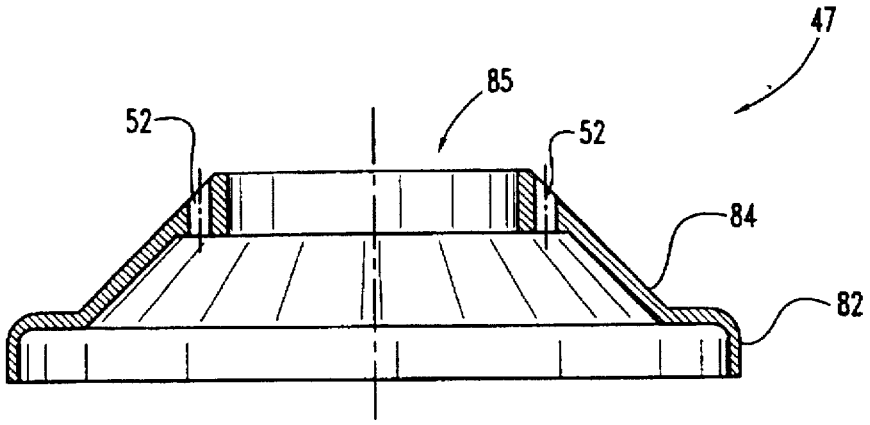
FIG. 6 is a front elevational view in full section of the FIG. 5 bottom plate as viewed in the direction of arrows 6—6 in FIG. 5.
Figure 5:
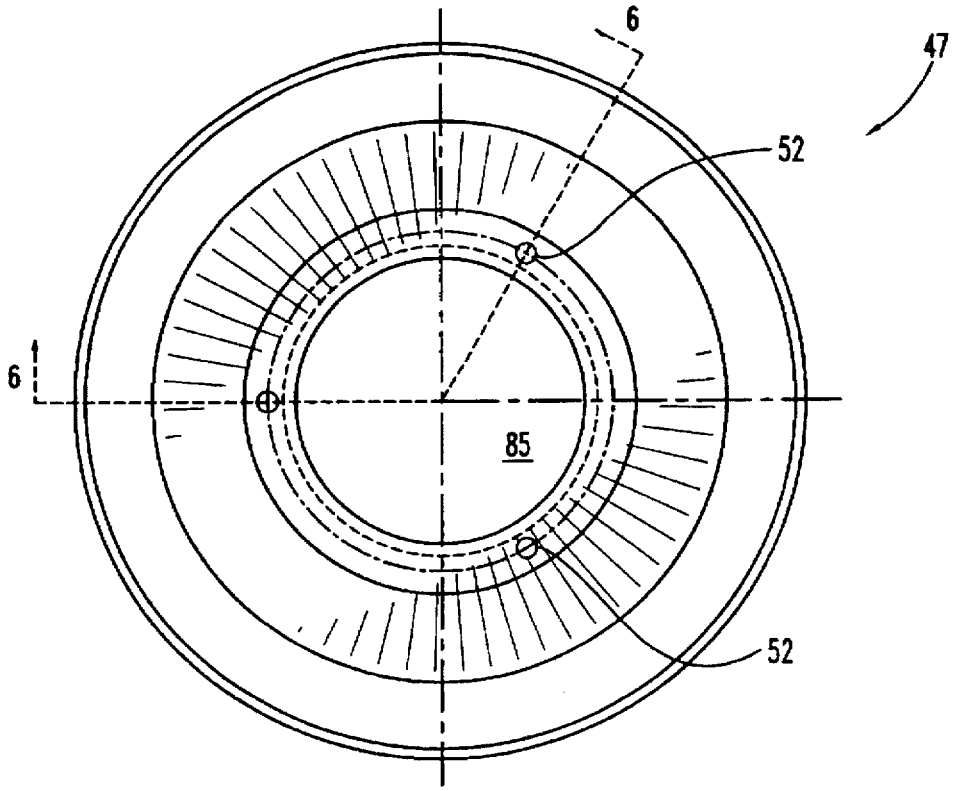
FIG. 5 is a top plan view of a bottom plate comprising one component of the FIG. 2 centrifuge according to the present invention.

Referring to FIGS. 5 and 6, the machined bottom plate 47 is illustrated in greater detail, including a top plan view in FIG. 5 and a side elevational view in full section in FIG. 6. Bottom plate 47 is hollow and has a shape which in some respects is similar to a truncated cone. Lower outer wall 82 is sized and arranged (annular) to fit into annular channel 83 which is formed into base plate 22. Outer wall 82 completes the assembled interface involving annular seal 33. Annular seal 33 is tightly wedged between bowl 21, base plate 22 and wall 82 so as to create a liquid-tight interface at that location so as to prevent any oil leakage.

Conical wall portion 84 which extends radially inwardly beyond the three equally spaced clearance holes 52 provides the support surface for the stack 42 of sixty-three cones 43. Bottom plate 47 is supported by base plate 22 and the stack 42 of cones is supported by plate 47. The remainder of the assembly (see FIG. 2) has previously been described. The inside diameter size of top opening 85 provides flow clearance relative to tube 23 for the liquid which leaves each of the cone channels (i.e., the defined spaced between adjacent cones 43). This exiting flow passes downwardly to nozzle orifices 34 and 35. These nozzles are pointed tangentially in opposite directions and use the exiting velocity of the liquid jets to spin centrifuge 20 within its associated cover assembly (not shown).

Referring to FIGS. 7 and 8, one of the sixty-three cones 43 is illustrated in greater detail, including a bottom plan view in FIG. 7 and a front elevational view in full section in FIG. 8. Note that in FIG. 8 the features on the back side inner surface have been omitted for drawing clarity, and the view has been inverted to agree with the FIG. 2 cone orientation. Each cone 43 has an inclined wall 89 which is truncated, thereby creating upper opening (inside diameter) 90. Formed on the inside surface of wall 89 are a series of six spaced, curved ribs 91–96. These curved or helical ribs can be thought of as configured into two different styles. Ribs 91, 93, and 95 have a similar shape and geometry to each other while ribs 92, 94 and 96 likewise have a similar shape and geometry to each other. While all six ribs have a similar width, length, height and curative, they differ in one respect. Ribs 92, 94 and 96 extend around mounting holes 97 which are equally spaced around wall 89. These three mounting holes 97 each receive one of the threaded rods 48.

With regard to the FIG. 7 illustration, which includes the six helical ribs 91–96, the direction of cone rotation is in the clockwise direction as looking into the plane of the paper. Alternatively the six helical (curved) ribs 91–96 could be replaced with straight radial ribs 103–108 (see FIGS. 9 and 10) in which case the direction of rotation could be clockwise or counterclockwise. Further, while the number of ribs may be increased or decreased, it is preferred for liquid flow symmetry and balance to have the ribs equally spaced and similarly styled.

The fact that each of the six ribs (vanes) has a substantially uniform height is important because these ribs define the cone-to-cone spacing between adjacent cones 43. In effect, the sixty-three cones stack one on top of the other as illustrated in FIG. 2. The clearance left between adjacent cones is created by the ribs such that the ribs of one cone are in contact with the outer surface of the adjacent cone which is geometrically positioned therebeneath.

The inside surface area of wall 89 which exists between and around each rib 91–96 provides the flow path for the liquid which is being cleaned. The six flow clearance holes 98 are equally spaced around wall 89. As will be appreciated from the FIG. 2 illustration, the degree of separation between adjacent cones is extremely small (0.02–0.03 inches), noting that the height of each rib 91–96 is likewise and correspondingly quite small. In order to assist in the prevention of any of the cones collapsing or deflecting into contact with an adjacent cone along any portion of the cone surface area between the ribs, a larger number of small raised protuberances or bumps 99 are provided. The height of each bump 99 is substantially the same as the height of each rib 91–96. Although the spacing and location of bumps 99 may appear to be random, the same general pattern, although random in some respects, is repeated six times around wall 89 in order to balance their supportive pattern throughout wall 89. If a fewer number of cones are used to fill the desired space in bowl 21, then the gap between adjacent cones (i.e. their separation distance) will increase. It is anticipated that separation distances between cone bodies of between 0.02 and 0.30 inches will be acceptable.

The innermost edge of each clearance hole 98 is positioned so as to be axially aligned with outer wall portion 73 of top plate 46. In this way the liquid which flows over the outer edge of top plate 46 will flow downwardly into the flow holes 98. From there the liquid travels upwardly and inwardly between adjacent cones toward openings 90. The direction of travel between adjacent cones also has an angular component due to the curved (helical) nature of ribs 91–96 which define the available flow channels or vanes between adjacent cones. When the openings 90 are reached the flow begins an axially downward path through bottom plate 47 and on to the nozzle orifices 34 and 35 (note the FIG. 2 flow direction arrows).

Figure 10:
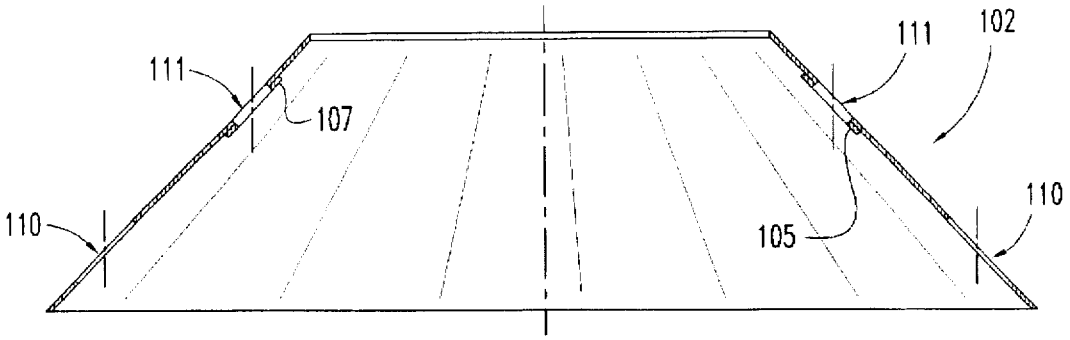
FIG. 10 is an enlarged front elevational view in full section of the FIG. 9 truncated cone as viewed in the direction of arrows 10—10 in FIG. 9 and inverted to agree with the FIG. 2 orientation.
Figure 9:
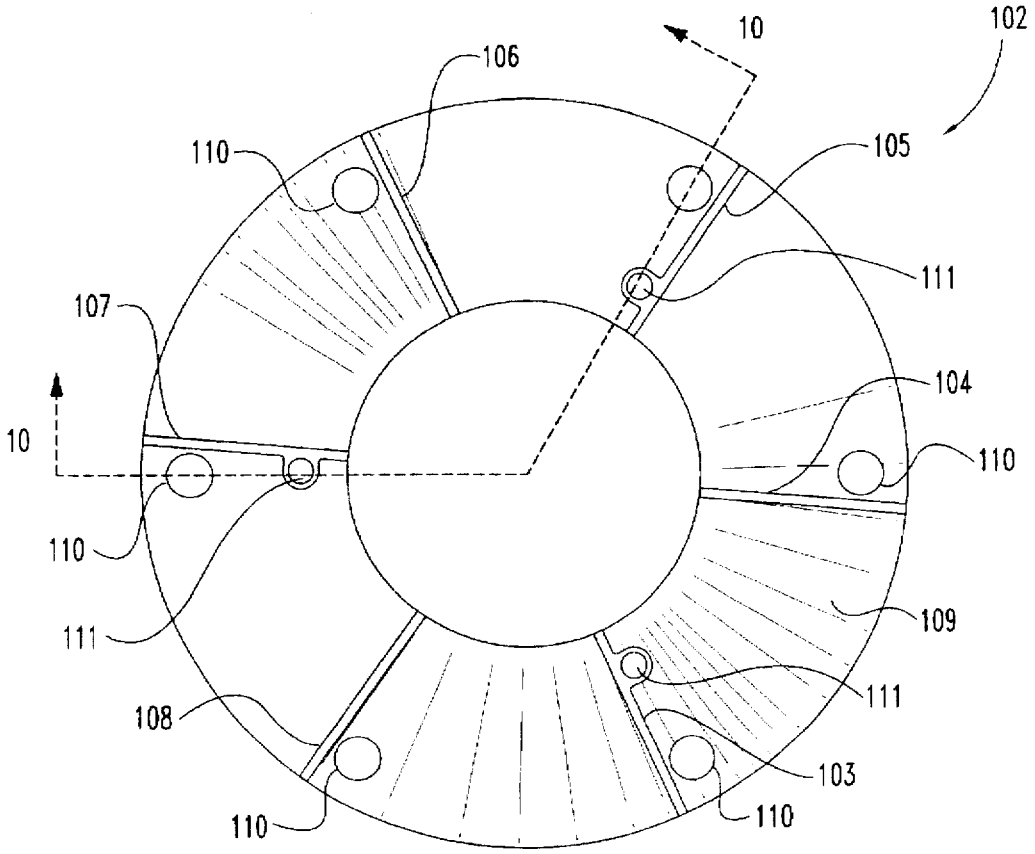
FIG. 9 is a bottom plan view of a truncated cone which may be used as one portion of the FIG. 2 centrifuge according to the present invention.

Referring to FIGS. 9 and 10 an alternative style of truncated cone 102 is illustrated. FIGS. 9 and 10 are intended to correspond generally to the arrangement of views seen with FIGS. 7 and 8. FIG. 9 is a bottom plan view and FIG. 10 is a sectional view which has been inverted so as to agree with the cone orientation of FIG. 2. The features on the back side inner surface have been omitted for drawing clarity. Cone 102 includes six straight radial ribs 103–108 which are equally spaced across the conical surface 109 of cone 102. The six flow holes 110 are equally spaced on the same diameter and the three mounting holes 111 are also equally spaced though located at a small diameter. Cone 102 is a suitable replacement for each of the sixty-three cones 43 arranged into stack 42. By using straight ribs the direction of rotation of cone 102 may be either clockwise or counterclockwise.

Centrifuge 45 is illustrated in a vertical or upright orientation relative to the engine block. In this orientation it should be clear that the sludge accumulation will be along the bottom and sides of the centrifuge bowl 21. When the accumulation of sludge builds up to the point that it interferes with the flow of oil through the cones, it is time to clean the centrifuge.

The steps involved in the disassembly of centrifuge 45 should be fairly clear from the drawing illustrations provided. Removal of nut 28 permits the centrifuge bowl 21 and cone-stack 42 to pull out of engagement with base plate 22 and slide off of tube 23. Thereafter the three threaded rods 48 are removed and the individual cones 43 disassembled. At this point all of the individual component parts are able to be cleaned. Once cleaned, and with the sludge removed, the centrifuge 45 is ready to be reassembled. While the disassembly steps can be reversed, greater care and attention must be given to be sure that all the parts, especially the cones 43, are properly aligned.

In order to provide an option to the FIG. 2 configuration design, attention was directed to creating a removable, disposable cone-stack subassembly. This related embodiment of the present invention is illustrated in FIGS. 11–22. This embodiment provides novel and unobvious benefits by means of a cone-stack subassembly which is of an all-plastic construction and designed to be disposable and then replaced with a new, clean subassembly.

Figure 11:
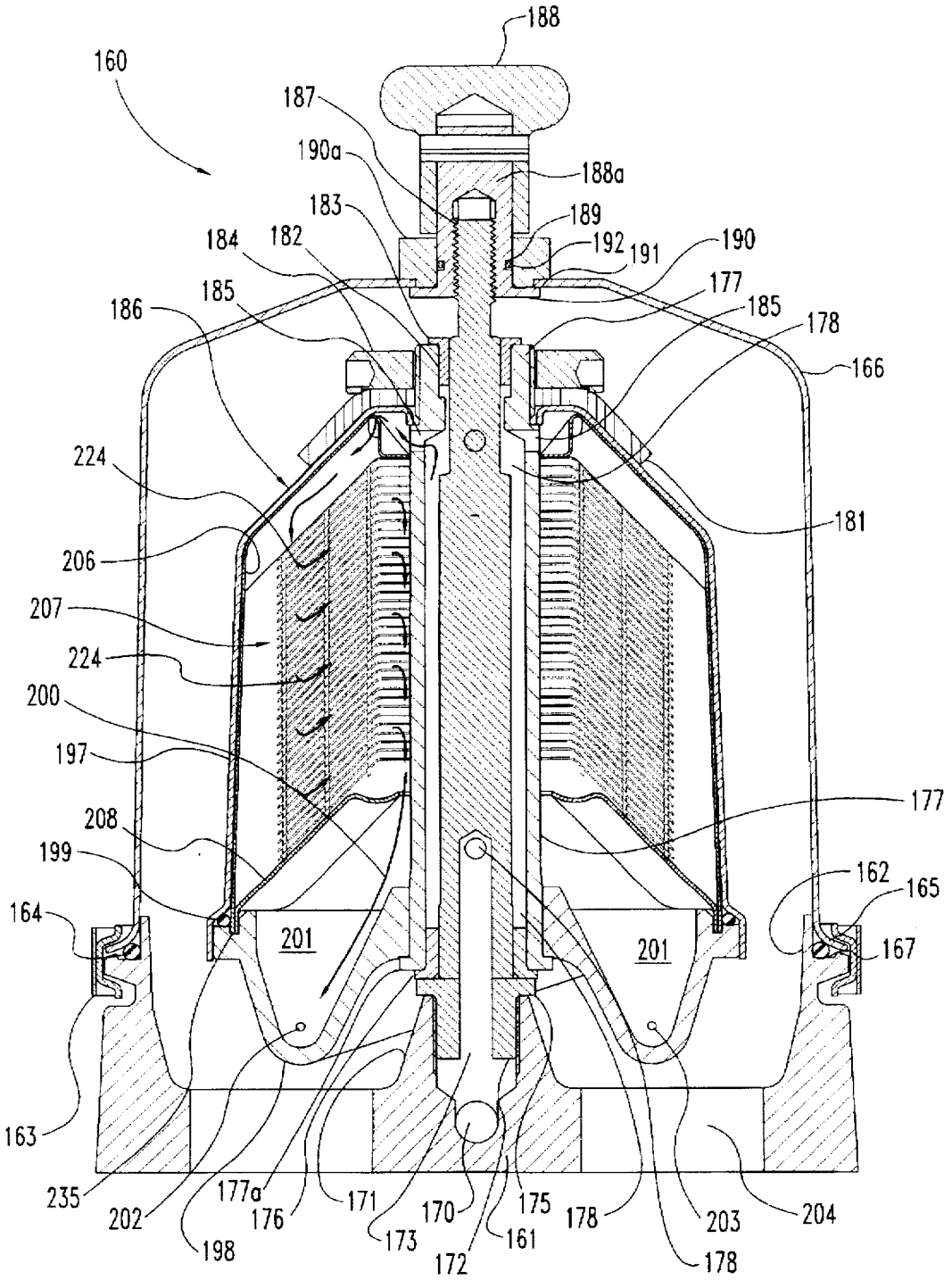
FIG. 11 is a diagrammatic front elevational view in full section of a self-driven, cone stack centrifuge according to a typical embodiment of the present invention.

Referring to FIG. 11, a self-driven, cone-stack centrifuge 160 according to another embodiment of the present invention is illustrated. Centrifuge 160 is oriented in a vertical position and mounted on the mounting pad 161 of an engine block. The specific mounting method involves an annular lip 162 formed as part of the mounting pad, an annular band clamp 163 and O-ring 164. The annular edge lip 165 of outer shell 166 is clamped to lip 162 and O-ring 164 is wedged into channel 167. This creates a secure and liquid-tight interface. This assembly arrangement is typical of what can be used for centrifuge 45.

Mounting pad 161 includes an oil delivery inlet 170 and an internally-threaded annular mounting stem 171. Threaded into stem 171 is centershaft 172 which is hollow for part of its length, the hollow portion 173 terminating adjacent to two fluid apertures 174. Flange 175 seats against the end of stem 171 while shouldered bearing sleeve 176 coaxially positions centershaft 172 within centertube 177. The coaxial spacing created by sleeve 176 provides an annular clearance space 178 between the centershaft 172 and centertube 177.

One end of centertube 177 is configured with an annular flange **177*a* which abuts up against bearing sleeve 176. At the opposite end of centertube 177 an annular recessed portion 182 receives a shouldered annular bearing sleeve 183. The outer surface of this opposite end of centertube 177 is externally threaded and receives a securing nut 184. Positioned between securing nut 184 and the replaceable cone-stack subassembly 186 is an annular support washer 181. Washer 181 is shaped so as to fit closely against the upper portion of the cone-stack subassembly 186. At a location which is axially adjacent the externally threaded portion, the centertube 177 includes four equally spaced fluid exit apertures 185**.

The oil circulation path through centrifuge 160 begins with incoming oil flowing in via oil delivery inlet 170 and proceeding through the hollow portion 173 to apertures 174. The flow progresses through apertures 174 into annular clearance space 178. The flow continues to the right in the FIG. 11 illustration and exits the clearance space 178 via exit apertures 185. At this point the oil enters the replaceable cone-stack subassembly 186 which will be described in greater detail hereinafter.

Extending beyond bearing sleeve 183, centershaft 172 has a reduced diameter portion 187 which is externally threaded and mates with handle 188. Handle 188 includes a shouldered inner stem **188*a*, an O-ring channel 189 and a retaining flange 190. Spacer 190*a* completes this portion of the assembly. An annular lip portion 191 of outer shell 166 abuts up against O-ring 192 and retaining flange 190 helps to maintain the axial positioning of the assembled components. As should be understood, once band clamp 163 is released, the outer shell and handle 188 can be unscrewed as a connected subassembly from centershaft 172. Annular, permanent centrifuge bowl 197 fits over the outer annular surface of base 198. Once centrifuge bowl 197 is pushed into position, O-ring 199 is compressively clamped to create a liquid-tight interface. After the assembly of centrifuge bowl 197 onto base 198, the securing nut 184 is threaded onto centertube 177**.

Figure 12:
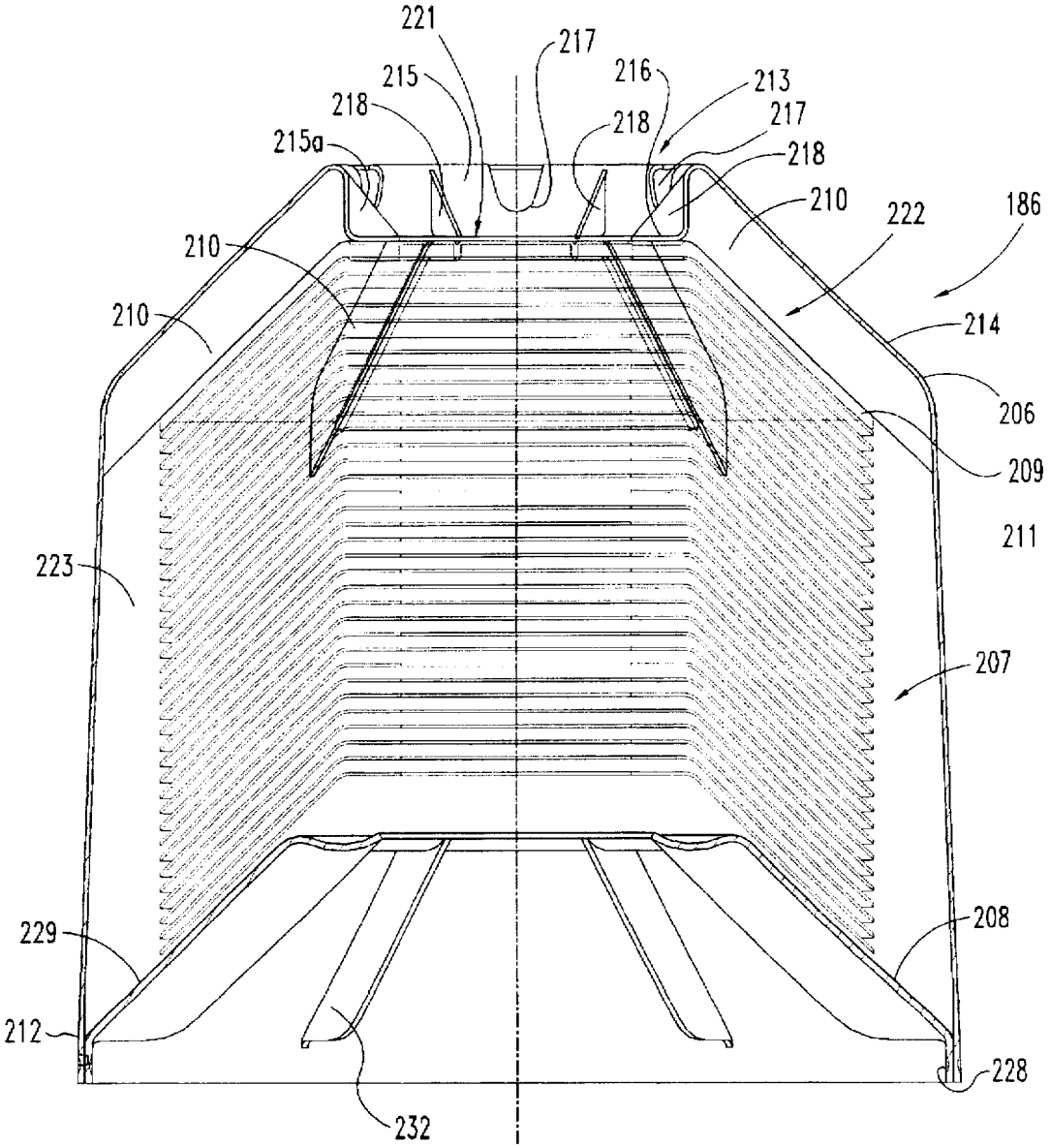
FIG. 12 is a diagrammatic front elevational view in full section of a cone stack subassembly which comprises a portion of the FIG. 11 centrifuge.
Figure 13:
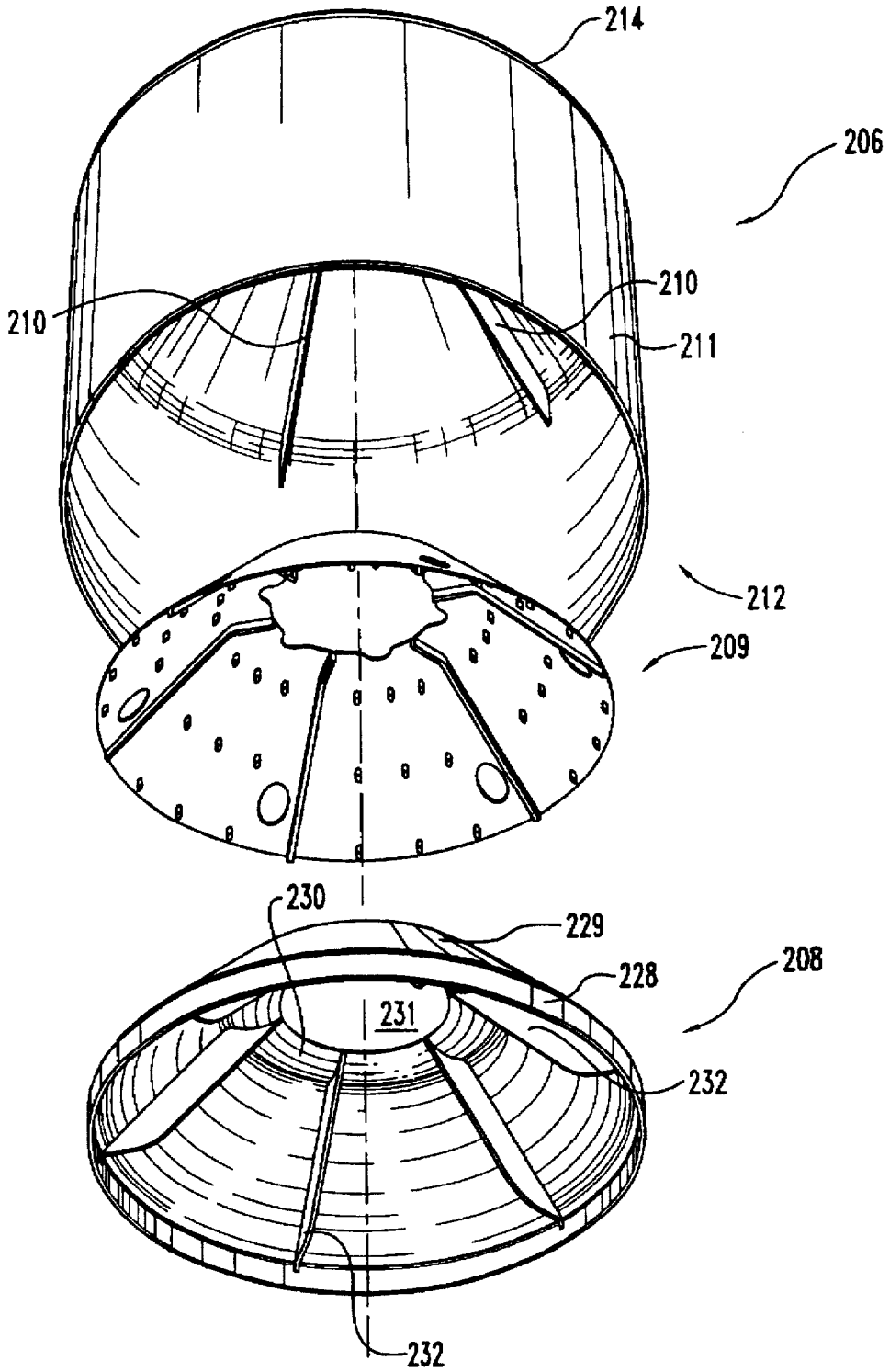
FIG. 13 is a partial exploded view of the FIG. 12 subassembly, with only one cone illustrated.
Figure 14:
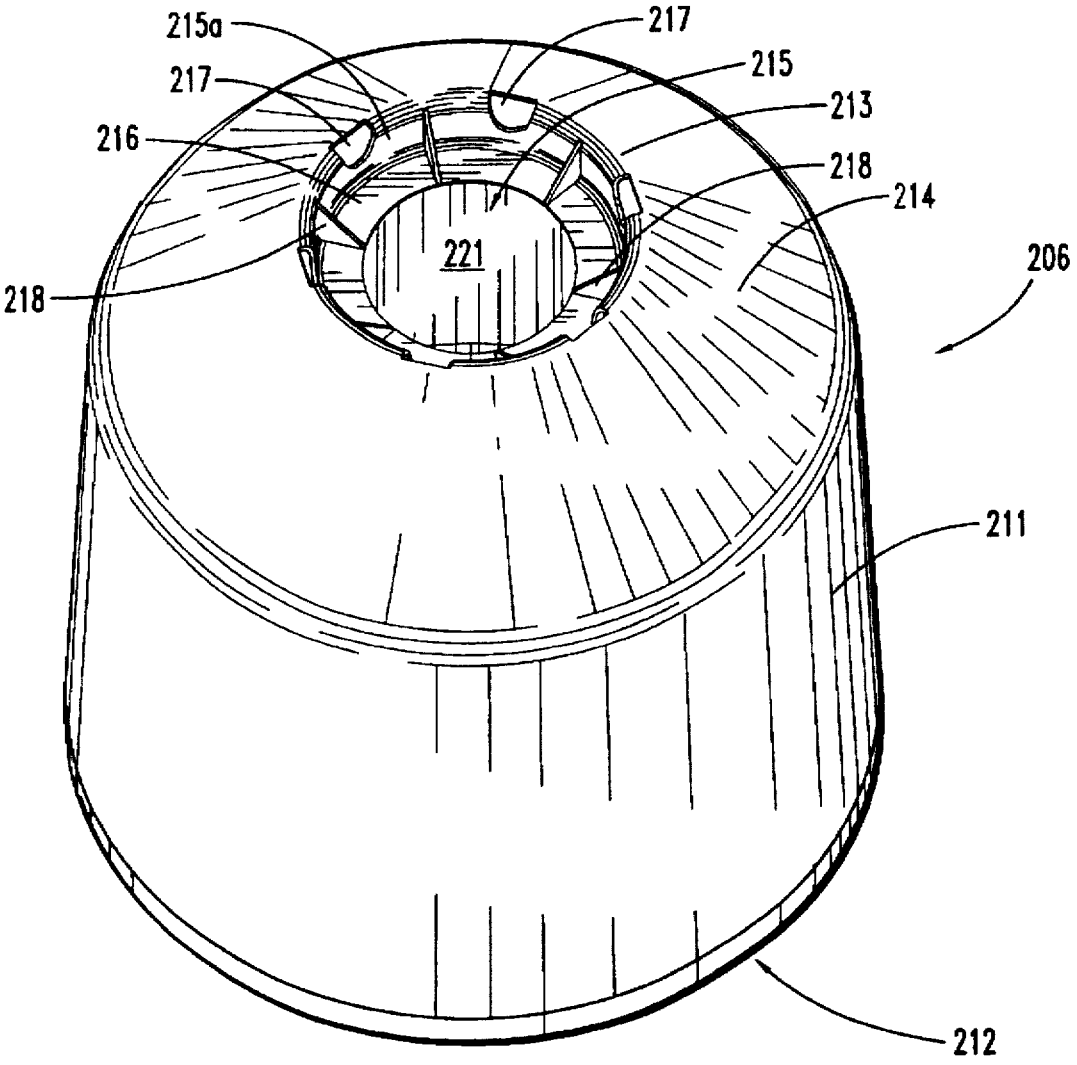
FIG. 14 is a top perspective view of a liner shell comprising one portion of the FIG. 12 subassembly.
Figure 15:
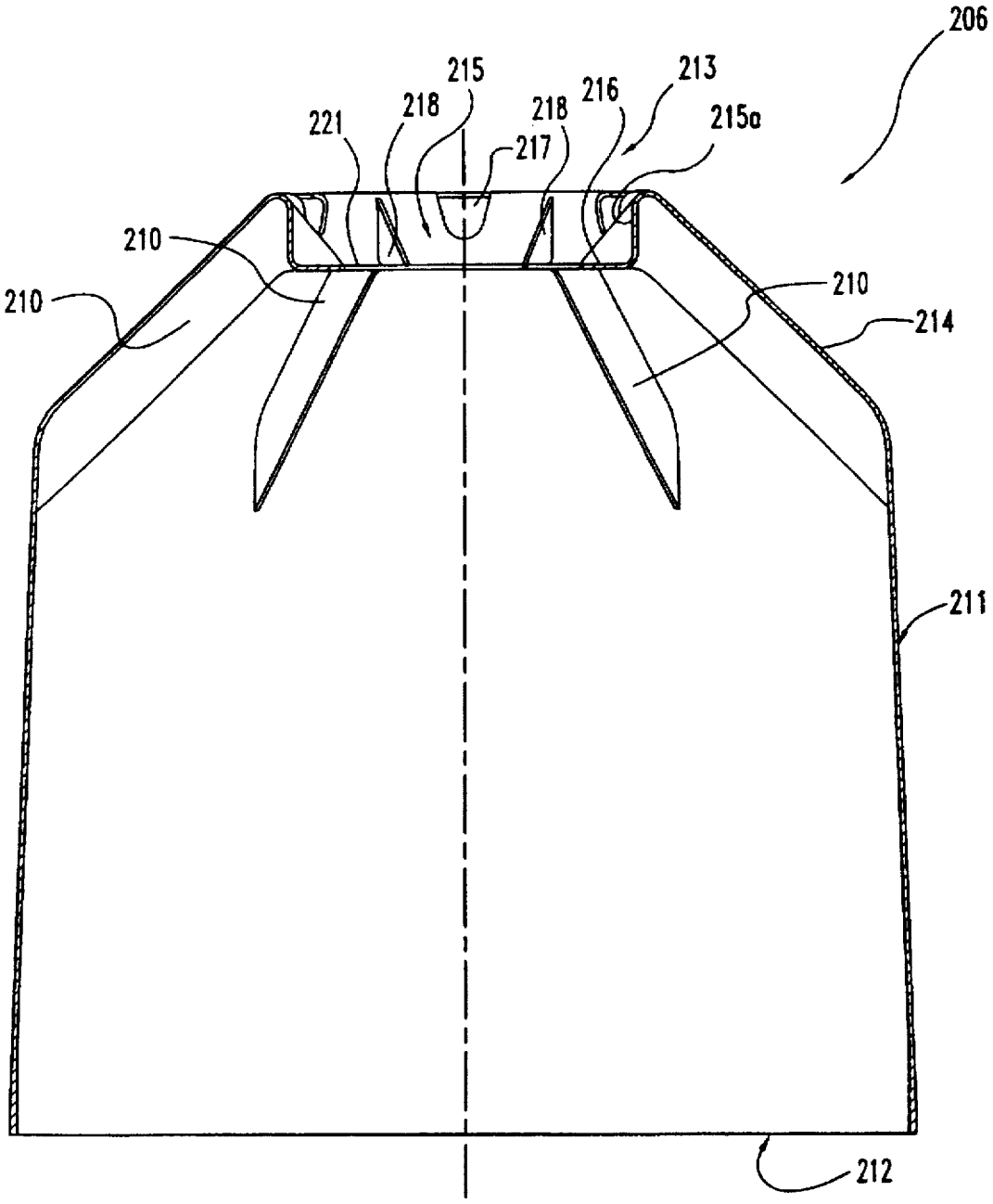
FIG. 15 is a front elevational view in full section of the FIG. 14 liner shell.
Figure 16:
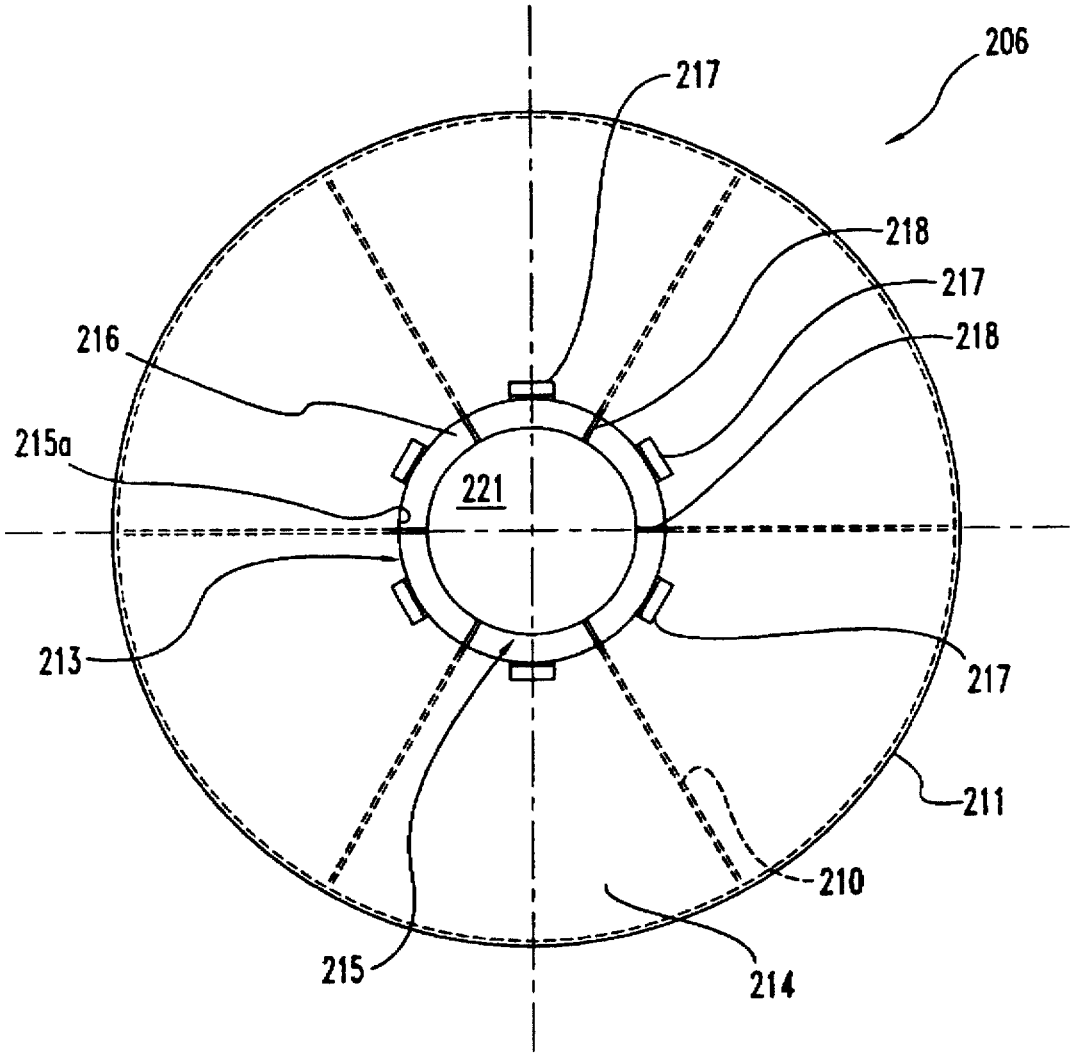
FIG. 16 is a top plan view of the FIG. 14 liner shell.
Figure 17:
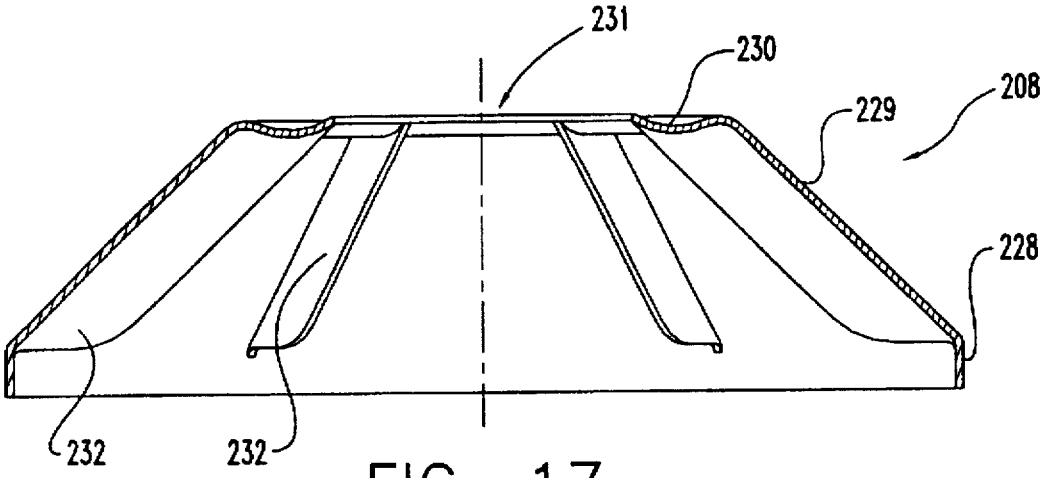
FIG. 17 is a front elevational view in full section of a bottom plate comprising a portion of the FIG. 12 subassembly.
Figure 18:
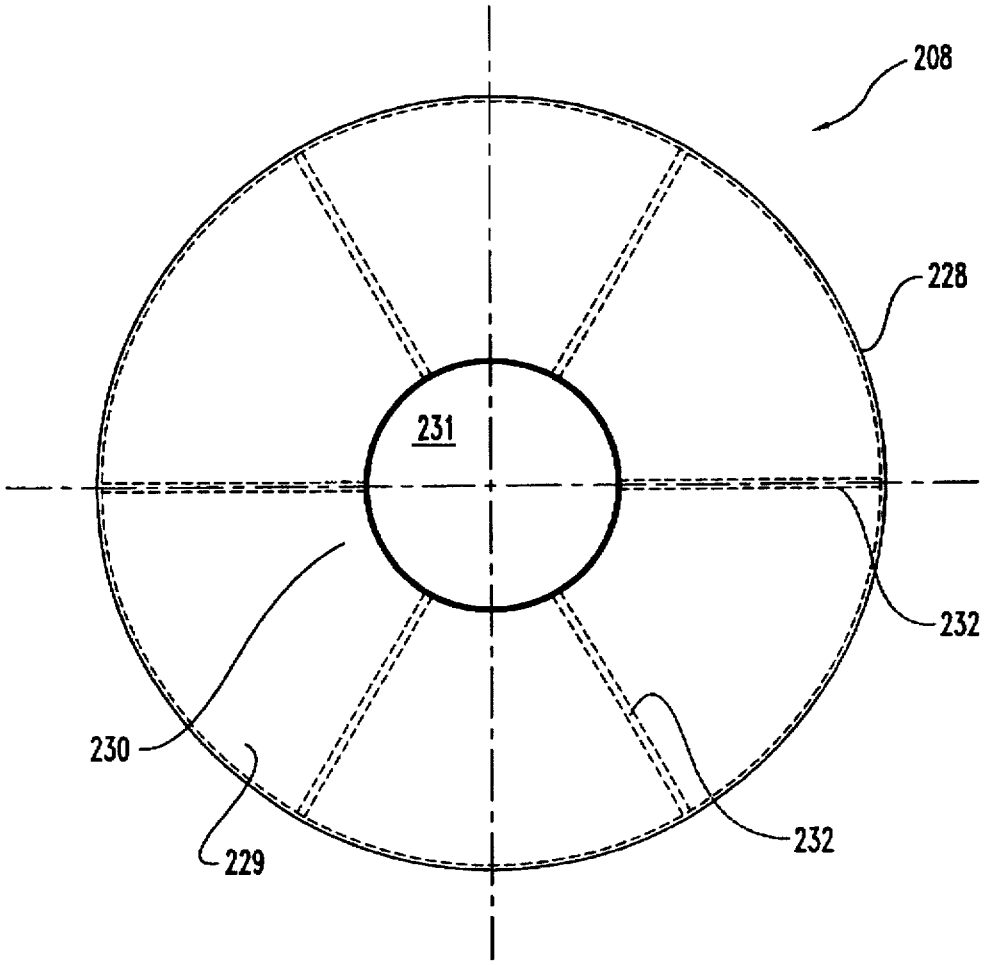
FIG. 18 is a top plan view of the FIG. 17 bottom plate.
Figure 19:
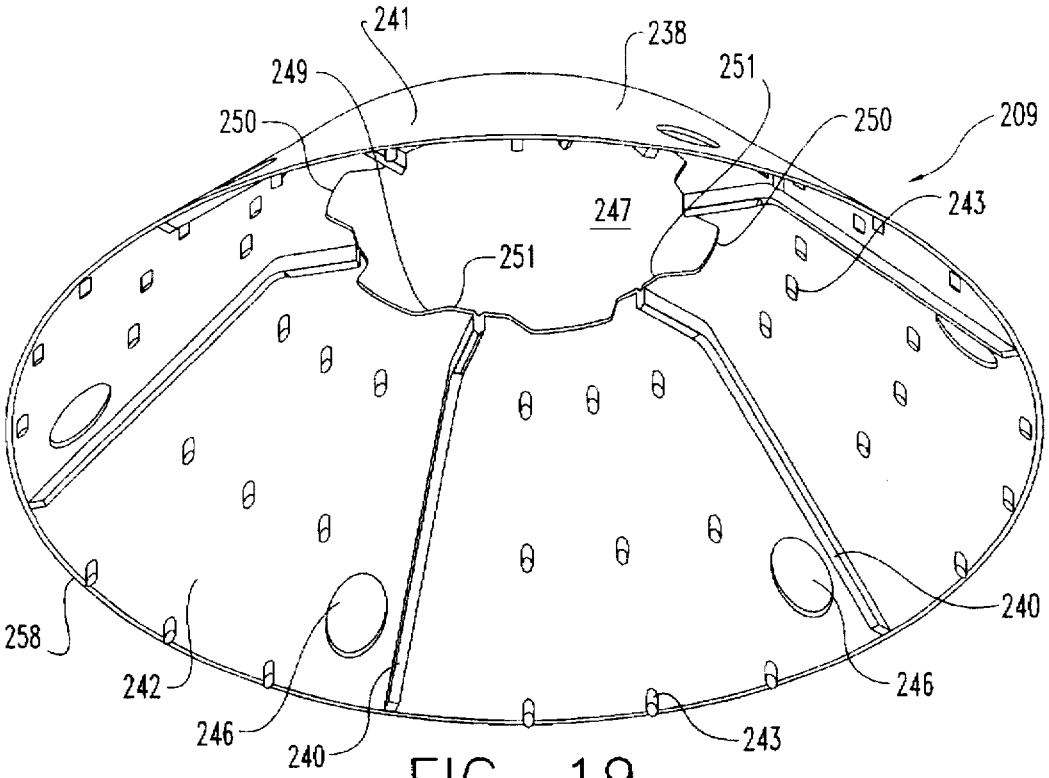
FIG. 19 is a bottom perspective view of one cone of the cone stack comprising a portion of the FIG. 12 subassembly.
Figure 20:
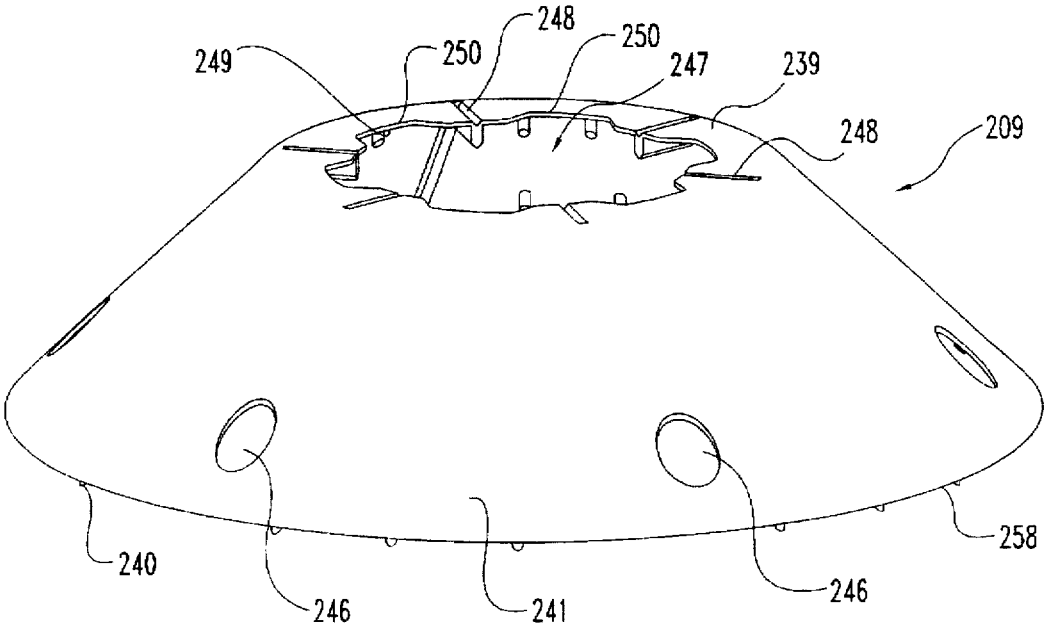
FIG. 20 is a top perspective view of the FIG. 19 cone.
Figure 22:
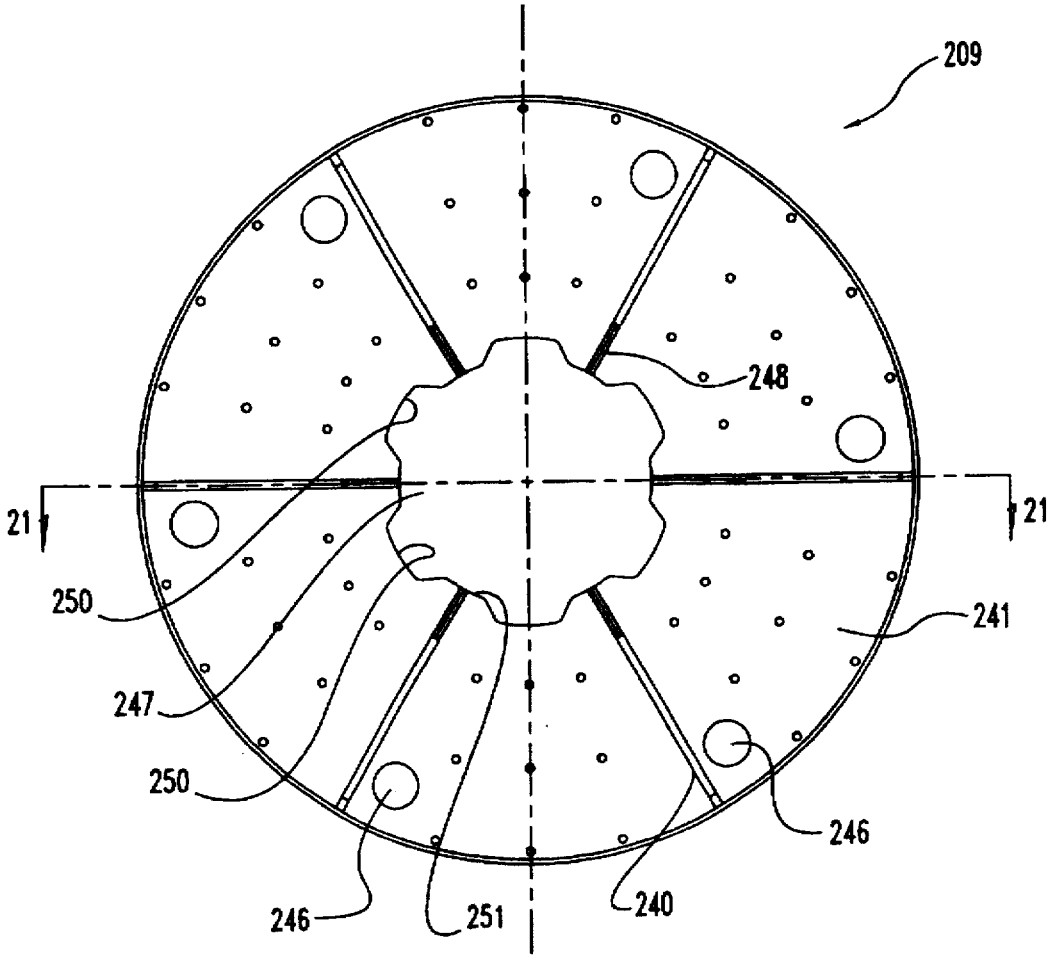
FIG. 22 is a bottom plan view of the FIG. 19 cone.

The oil flowing through the cone-stack subassembly 186 exits through an annular zone 200 which is adjacent to the outer surface of centertube 177. This oil flows into annular zone 201 and from there, exits through tangential flow nozzles 202 and 203. The high pressure of the exiting oil jets through tangential flow nozzles 202 and 203 creates a rapidly spinning action of the cone-stack subassembly 186 around centershaft 172. The oil exiting from nozzles 202 and 203 drains through opening 204. While the centertube 177, nut 184, centrifuge bowl 197, base 198, and O-ring 199 also spin, the cone-stack subassembly 186, as defined herein as a disposable, replaceable cone-stack subassembly, does not include any of these other components. The cone-stack subassembly 186 as illustrated in FIG. 12 includes a liner shell 206, cone stack 207, and bottom plate 208. An exploded view of these components, though with only one cone 209 of cone stack 207 included, is illustrated in FIG. 13. The centrifuge bowl 197 mates with the outer surface of liner shell 206. The pressure load is carried by the centrifuge bowl 197 while the cone-stack subassembly 186 captures the sludge load. Additional details of the liner shell 206 are illustrated in FIGS. 14 through 16. Additional details of bottom plate 208 are illustrated in FIGS. 17 and 18. The details of a representative cone 209 of cone stack 207 are further illustrated in FIGS. 19 through 22.

Referring first to FIGS. 12 and 13, the details of the cone-stack subassembly 186 are illustrated. The vertical orientation for centrifuge 160 was selected for FIG. 11 as the preferred orientation for the centrifuge relative to the engine block. Accordingly, FIG. 12 presents the subassembly as it would normally be oriented. The remaining illustrations are based on the vertical orientation of FIG. 11.

Liner shell 206 (see FIGS. 14-16) is a molded, unitary thin-walled plastic vessel with an annular, hollow shape and six equally spaced radial acceleration vanes 210. These radial acceleration vanes support the cone stack 207. Liner shell 106 includes an annular body portion 211 which converges slightly (approximate 2 degree taper) from open end 212 to partly closed end 213. Extending between body portion 211 and end 213 is frustoconical portion 214 which tapers at an approximate 45 degree angle. End 213 is open with a cylindrical recess 215 defined by inner wall **215*a* and substantially flat shelf 216. The inner wall 215*a* of recess 215 defines six, equally-spaced flow apertures 217 and dividing vane tips 218. The six vane tips 218 are located midway (circumferentially) between adjacent flow apertures 217 and the tips are coplanar extensions of radial acceleration vanes 210. Vanes 210 are on the inside surface of the wall defining frustoconical portion 214 exterior to inner wall 215*a* with a small portion (tip) of each vane extending into body portion 211. Vane tips 218 are positioned in the corner between the interior surface of wall 215*a* and the adjacent outer surface of shelf 216**.

The flow of oil out through fluid exit apertures 185 is directed radially toward inner wall **215*a* and due to shelf 216 and the fit of opening 221 against centertube 177, the flowing oil travels radially outward through flow apertures 217 and toward body portion 211. A clearance space 222 is disposed between the first cone 209 in cone stack 207 and frustoconical portion 214. This space is divided into six flow paths by means of vanes 210. Space 222 extends into annular clearance space 223 which is disposed between the outer edges of cones 209 and body portion 211. Once space 223 fills with oil, the flow path of least resistance is through each cone via six openings in each and then in a radially inward direction along the surface of each cone toward centertube 177. The conical shape of each cone 209 means that the flow will be inclined as indicated by the flow arrows 224 in FIG. 11. The inside edge of each cone includes enlarged apertures which provide a flow path along the outer surface of centertube 177 in the direction of zone 200**.

Referring to FIGS. 17 and 18, bottom plate 208 is a unitary, molded plastic, generally frustoconical member with a relatively short cylindrical wall 228, tapered body portion 229, and radial shelf 230 which defines center opening 231. Six equally-spaced stiffening webs 232 are disposed on the inner surfaces of body portion 229 and shelf 230. The body portion 229 and the webs 232 are oriented on a 45 degree angle which matches the angular incline of vanes 210 and the conical taper of cones 209. As such, the bottom plate 208 provides support to the "bottom" of the cone stack, which is the lower end in FIG. 11 closest to the base 198. Cylindrical wall 228 is spot welded at six equally-spaced locations to annular body portion 211 at a location adjacent open end 212. This plastic spot welding secures together the liner shell 206 and the bottom plate 208 as an integral subassembly. This integral subassembly is thus a self-contained module which can be easily handled for installing and removing. The double-walled thickness of the integral subassembly, including cylindrical wall 228, is received within an annular groove 235 disposed in base 198. This double-walled thickness provides one abutment surface for contact with O-ring 199. In lieu of a plastic spot welded assembly of bottom plate 208 to liner shell 206, the short cylindrical wall 228 may incorporate a plastic snap-fit ridge to mate with the liner shell.

Center opening 231 has a diameter size which is larger than the outside diameter of centertube 177 such that the exiting flow from the cone stack 207 is able to flow into zone 200.

The cone stack 207 includes an aligned stack of thirty-four virtually identical, frustoconical, thin-walled plastic cones 209 (see FIGS. 19–22). Each cone 209 is of a molded, unitary construction and includes a frustoconical body 238, upper shelf 239, and six equally-spaced vanes 240 formed on the inner surfaces of body 238 and shelf 239. The outer surface 241 of each cone 209 is substantially smooth throughout while the inner surface 242 includes, in addition to the six vanes 240, a plurality of projections 243 which help to maintain precise and uniform cone-to-cone spacing between adjacent cones under high pressure conditions. Disposed in body 238 are six equally-spaced openings 246 which provide the entrance path for the oil flow between adjacent cones 209. Each opening 246 is positioned adjacent to a different and corresponding one of the six vanes 240.

Alignment of cones 209 is important in two respects. Axially, a uniform spacing between adjacent cones contributes to the overall balance of the flow paths and particle separation and yields a greater separation efficiency. Circumferentially it is important for the cones 209 to be rotated into alignment such that the openings 246 in one cone are aligned with the openings in the adjacent cone. This permits a uniform and balanced oil flow through each cone into the separation space between adjacent cones. In order to achieve the desired axial spacing, the pattern of projections 243 are utilized. For the circumferential (radial) alignment there is a mating of ribs in one cone with corresponding grooves in the adjacent cone for engagement. This relationship repeats throughout the stacked array of cones 209.

Digressing for a moment, FIGS. 11 and 12 should be regarded as primarily diagrammatic illustrations due to certain drawing technicalities which have been omitted in the interest of drawing clarity. The sectioned nature of the individual cones 209 within subassembly 186 would mean that some portion of the openings 246, vanes 240 and projections 243 on the back side of each cone would be partially visible through the slight separation of adjacent cones. Since these features of each cone 209 have been illustrated in all respects in FIGS. 19–22, these features were omitted in FIGS. 11 and 12. A similar explanation applies to FIG. 2.

The shelf 239 defines a centered and concentric aperture 247 and surrounding aperture 247 in a radially-extending direction are six equally-spaced, V-shaped grooves 248 which are aligned with the six vanes 240. The grooves 248 of one cone receive the upper portions of the vanes of the adjacent cone and this controls proper circumferential alignment. Aperture 247 has a generally circular edge 249 which is modified with six semi-circular, enlarged openings 250. The openings 250 are equally-spaced and positioned midway (circumferentially) between adjacent vanes 240. The edge portions 251 which are disposed between adjacent openings 250 are part of the same circular edge with a diameter which is closely sized to the outside diameter of centertube 177. The close fit of edge portions 251 to the centertube 177 and the enlarged nature of openings 250 means that the exiting flow of oil through aperture 247 is limited to flow through openings 250. As such, the exiting oil flow from cone stack 207 is arranged in six equally-spaced flow paths along the outside diameter of centertube 177 into zone 200. The circumferential position of openings 250 results in these openings being centered between vanes 210 in liner shell 206 and also centered between webs 232. This in turn means that liner shell 206, cone stack 207, and bottom plate 208 are rotated about the longitudinal axis of centertube 177 such that the vanes 210, vanes 240, and webs 232 are all circumferentially and axially aligned. This aligned arrangement means that there are six circumferentially spaced flow corridors which extend through the liner shell 206, cone stack 207, and bottom plate 208.

Figure 21:
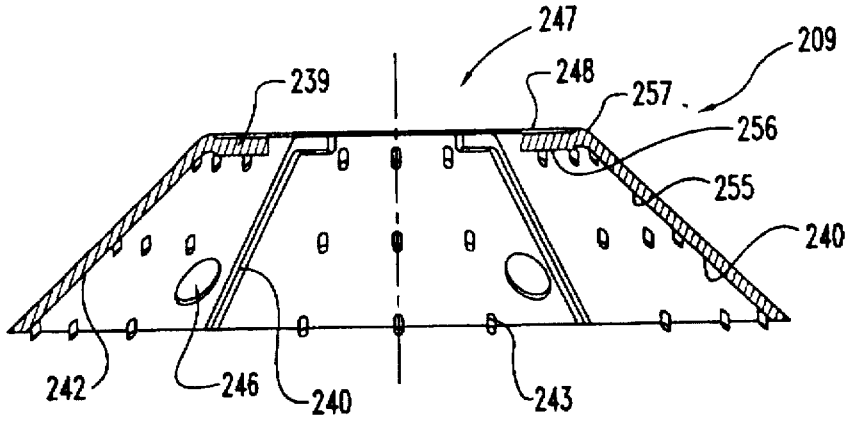
FIG. 21 is a side elevational view in full section of the FIG. 19 cone.
Figure 21A:
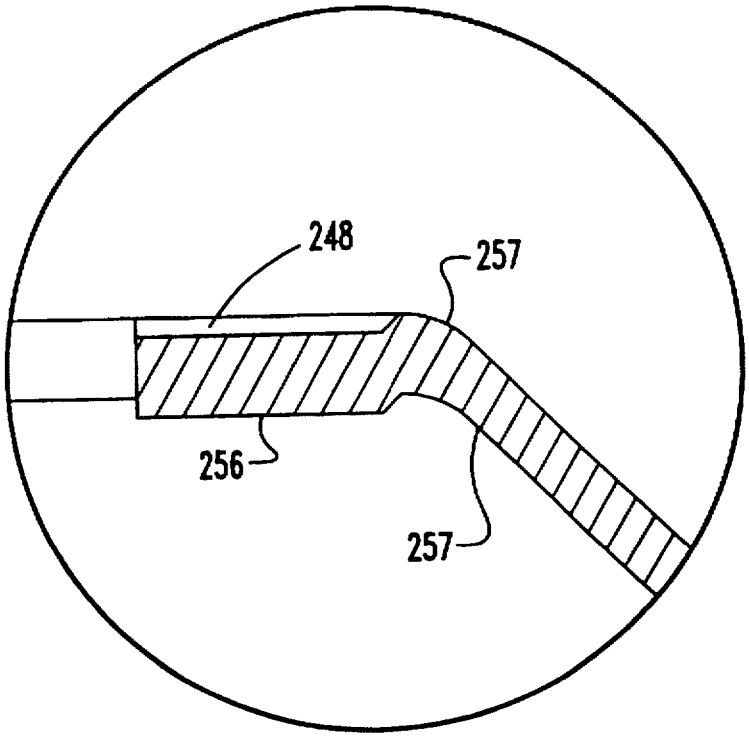
FIG. 21A is a detail view of a portion of the FIG. 21 cone.

Each of the vanes 240 are configured in two portions 255 and 256. Side portion 255 has a uniform thickness and extends from radiused corner 257 along body 238 and slightly beyond annular edge 258. There are six integral upper portions 256, each of which is recessed below and circumferentially centered on a corresponding groove 248 (see FIG. 21A). Portions 256 function as ribs which notch into corresponding V-shape grooves 248 on the adjacent cone.

The cone-stack subassembly 186 consisting of liner shell 206, cone stack 207, and bottom plate 208 is a disposable, replaceable component which provides a unique and unobvious improvement. Once there is a build up of sludge in annular clearance space 223 which is at a level sufficient to interfere with the desired operation of centrifuge 160, the entire subassembly 186 is disassembled from the remainder of the centrifuge and discarded and a new, clean subassembly is installed. The removed subassembly 186 may be incinerated or recycled and its all-plastic construction contributes to the availability of these options.

Figure 23:
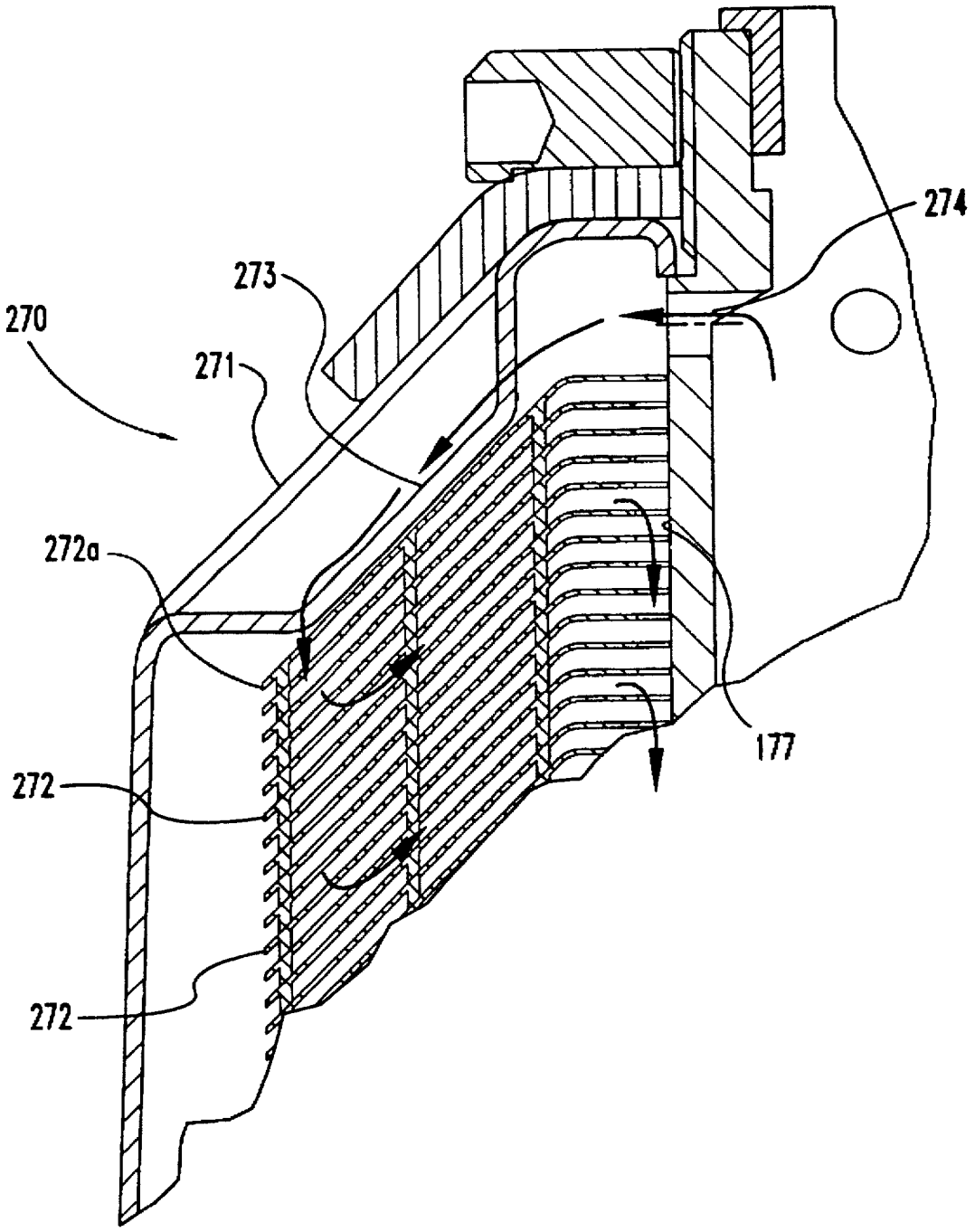
FIG. 23 is a partial front elevational view in full section of an alternative design according to the present invention.

While two primary embodiments have been described, there is another centrifuge arrangement which is a unique combination of features selected from the two primary embodiments. In FIG. 23, centrifuge 270 is arranged similar to centrifuge 45 without the replaceable subassembly 186. However, the top plate 46 is removed and its function is performed by a redesigned centrifuge bowl 271 which has a top angle designed to match the frustoconical shape of the cones 272 and a deep dimple rib 273 to position the top cone **272*a* beneath the inlet holes 274. Cones 272 are virtually identical to cones 209 including the design of aperture 247 and semicircular openings 250. However, top cone 272***a* has a modified configuration which includes the elimination of openings 250. As a result, there is no oil flow path through the center aperture of cone 272*a* between the cone and the centertube. As a result, the flow is routed to the outer edge of cone 272*a* and then progresses between adjacent cones in toward centertube 177. In this embodiment, the first cone 272*a* actually functions as a top plate or flow control plate due to its unique configuration and the manner in which that configuration controls the flow of oil as it exits from centertube 177.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A replaceable, self-contained, cone-stack subassembly for use in a self-driven, cone-stack centrifuge wherein said centrifuge is designed for separating particulate matter out of a flowing liquid, said cone-stack subassembly comprising:

an annular liner shell having a flow control first end and opposite thereto an open second end;

an annular bottom plate attached to the second open end of said liner shell and defining with said liner shell an interior cone space; and a plurality of separation cones arranged into a stacked array and positioned within said interior cone space.

2. The cone-stack subassembly of claim 1 wherein said flow-control first end includes a plurality of equally-spaced flow separation vanes and an alternating plurality of equally-spaced flow inlet apertures which admit said flowing liquid into said interior cone space.

3. The cone-stack subassembly of claim 2 wherein said bottom plate having an annular outer wall which is attached to said open second end with a sealed interface so as to close said open second end and sealingly enclose said interior cone space.

4. The cone-stack subassembly of claim 3 wherein each separation cone of said plurality of separation cones has a frustoconical shape with a center opening and outwardly spaced from said center opening a plurality of flow apertures.

5. The cone-stack subassembly of claim 4 wherein said center opening includes substantially circular edge portions and a plurality of enlarged edge portions which provide flow clearance for flow of liquid between said cones.

6. The cone-stack subassembly of claim 1 wherein each separation cone of said plurality of separation cones has a frustoconical shape with a center opening and outwardly spaced from said center opening a plurality of flow apertures.

7. The cone-stack subassembly of claim 6 wherein said center opening includes substantially circular edge portions and a plurality of enlarged edge portions which provide flow clearance for flow of liquid between said cones.

8. A stackable centrifuge cone constructed and arranged for use in a cone-stack centrifuge as one centrifuge cone of a plurality of centrifuge cones which are arranged as a stacked array on a centerpost, said stackable centrifuge cone comprising:

a main body portion including a surrounding sidewall defining a hollow interior and an upper wall defining a clearance aperture for receipt by said centerpost;

said upper wall having a first surface and opposite thereto a second surface; and a circumferentially aligned combination of a protruding V-shaped rib and a recessed V-shaped groove, said V-shaped rib and said V-shaped groove providing an alignment feature for said stackable centrifuge cone as part of a stacked array with other stackable centrifuge cones by positioning the V-shaped rib of one centrifuge cone into the V-shaped groove of an adjacent centrifuge cone of said stacked array.

9. The cone-stack centrifuge of claim 8 wherein there is a plurality of V-shaped ribs and a plurality of V-shaped grooves disposed as part of said centrifuge cone, said plurality of V-shaped ribs being substantially equally spaced around said centrifuge cone and said plurality of V-shaped grooves being substantially equally spaced around said centrifuge cone.

10. The stackable centrifuge cone of claim 8 wherein said surrounding sidewall is substantially conical and wherein said upper wall includes a first surface and opposite thereto a second surface, said V-shaped rib being disposed in one of said first and second surfaces and said V-shaped groove being disposed in the other of said first and second surfaces.

11. The stackable centrifuge cone of claim 10 wherein there is a total of six V-shaped ribs and a total of six V-shaped grooves disposed as part of the upper wall of each centrifuge cone, said six V-shaped ribs being substantially equally spaced around said upper wall portion and said six V-shaped grooves being substantially equally spaced around said upper wall.

12. The stackable centrifuge cone of claim 11 wherein each V-shaped rib and V-shaped groove combination of each centrifuge cone extends in a substantially straight radial direction from said clearance aperture outwardly across said upper wall.

13. The stackable centrifuge cone of claim 12 which further includes six sidewall ribs which are substantially equally spaced apart and which partition said centrifuge cone into six sections, each section having a substantially identical configuration such that cone-to-cone circumferential alignment between adjacent centrifuge cones can be achieved by rotating one cone about the centerpost a distance less than 60 degrees.

14. The stackable centrifuge cone of claim 13 wherein said centrifuge cone is a unitary, molded member.

15. The stackable centrifuge cone of claim 14 which further includes six sidewall ribs which are substantially equally spaced apart and which partition said centrifuge cone into six sections, each section having a substantially identical configuration such that cone-to-cone circumferential alignment between adjacent centrifuge cones can be achieved by rotating one cone about the centerpost a distance less than 60 degrees.

* * * * *